US008937575B2

(12) United States Patent
Ward et al.

(10) Patent No.: US 8,937,575 B2
(45) Date of Patent: Jan. 20, 2015

(54) MICROSTRIP ANTENNA ELEMENTS AND ARRAYS COMPRISING A SHAPED NANOTUBE FABRIC LAYER AND INTEGRATED TWO TERMINAL NANOTUBE SELECT DEVICES

(75) Inventors: Jonathan W. Ward, Fairfax, VA (US); Robert F. Smith, Odessa, FL (US); Brent M. Segal, Woburn, MA (US)

(73) Assignee: Nantero Inc., Woburn, MA (US)

( * ) Notice: Subject to any disclaimer, the term of this patent is extended or adjusted under 35 U.S.C. 154(b) by 564 days.

(21) Appl. No.: 12/533,687

(22) Filed: Jul. 31, 2009

(65) Prior Publication Data

US 2011/0025577 A1 Feb. 3, 2011

(51) Int. Cl.

| | |
|---|---|
| ***H01Q 1/38*** | (2006.01) |
| ***H01Q 21/08*** | (2006.01) |
| ***H01Q 9/04*** | (2006.01) |

(52) U.S. Cl.

CPC ..... *H01Q 9/0407* (2013.01); *H01Q 21/08* (2013.01)

USPC ..... 343/700 MS

(58) Field of Classification Search

USPC ..... 343/700 MS, 846, 848, 897; 977/950

See application file for complete search history.

(56) References Cited

U.S. PATENT DOCUMENTS

| | | | | |
|---|---|---|---|---|
| 5,155,493 | A * | 10/1992 | Thursby et al. | 343/700 MS |
| 6,057,637 | A | 5/2000 | Zettl et al. | |
| 6,277,318 | B1 | 8/2001 | Bower et al. | |
| 6,342,276 | B1 | 1/2002 | You et al. | |
| 6,409,567 | B1 | 6/2002 | Amey, Jr. et al. | |
| 6,423,583 | B1 | 7/2002 | Avouris et al. | |
| 6,495,116 | B1 | 12/2002 | Herman | |
| 6,495,258 | B1 | 12/2002 | Chen et al. | |
| 6,515,339 | B2 | 2/2003 | Shin et al. | |
| 6,528,020 | B1 | 3/2003 | Dai et al. | |
| 6,630,772 | B1 | 10/2003 | Bower et al. | |
| 6,645,628 | B2 | 11/2003 | Shiffler, Jr. et al. | |
| 6,706,402 | B2 | 3/2004 | Rueckes et al. | |
| 6,707,098 | B2 | 3/2004 | Hofmann et al. | |
| 6,808,746 | B1 | 10/2004 | Dai et al. | |

(Continued)

FOREIGN PATENT DOCUMENTS

| | | |
|---|---|---|
| GB | 2 364 933 A | 2/2002 |
| JP | 2000/203821 | 7/2000 |

(Continued)

OTHER PUBLICATIONS

Awano, Y., Graphene for VLSI: FET and Interconnect Applications,: IEDM 2009 Technical Digest, pp. 10.1.1-10.1.4.

(Continued)

*Primary Examiner* — Michael C Wimer

(74) *Attorney, Agent, or Firm* — Nantero Inc.

(57) ABSTRACT

A nanotube based microstrip antenna element is provided along with arrays of same. The nanotube based microstrip antenna element comprises a dielectric substrate layer sandwiched between a ground plane layer and a conductive nanotube layer, the conductive nanotube layer shaped to form a radiating structure. In more advanced embodiments, the nanotube based microstrip antenna element further includes an integrated two terminal nanotube switch device such as to provide a selectability function to such microstrip antenna elements and reconfigurable arrays of same. Anisotropic nanotube fabric layers are also used to provide substantially transparent microstrip antenna structures which can be deposited over display screens and the like.

17 Claims, 17 Drawing Sheets

(56) References Cited

U.S. PATENT DOCUMENTS

| | | | | |
|---|---|---|---|---|
| 6,833,558 | B2 | 12/2004 | Lee et al. | |
| 6,835,591 | B2 | 12/2004 | Rueckes et al. | |
| 6,858,197 | B1 | 2/2005 | Delzeit | |
| 6,863,942 | B2 | 3/2005 | Ren et al. | |
| 6,888,773 | B2 | 5/2005 | Morimoto | |
| 6,890,780 | B2 | 5/2005 | Lee | |
| 6,899,945 | B2 | 5/2005 | Smalley et al. | |
| 6,905,892 | B2 | 6/2005 | Esmark et al. | |
| 6,918,284 | B2 | 7/2005 | Snow et al. | |
| 6,919,592 | B2 | 7/2005 | Segal et al. | |
| 6,919,740 | B2 | 7/2005 | Snider | |
| 6,921,575 | B2 | 7/2005 | Horiuchi et al. | |
| 6,924,538 | B2 | 8/2005 | Jaiprakash et al. | |
| 6,946,410 | B2 | 9/2005 | French et al. | |
| 6,955,937 | B1 * | 10/2005 | Burke et al. | 438/53 |
| 7,057,402 | B2 | 6/2006 | Cole et al. | |
| 7,115,901 | B2 | 10/2006 | Bertin et al. | |
| 7,259,410 | B2 | 8/2007 | Jaiprakash et al. | |
| 7,335,395 | B2 | 2/2008 | Ward et al. | |
| 7,416,993 | B2 | 8/2008 | Segal et al. | |
| 7,566,478 | B2 | 7/2009 | Ward et al. | |
| 7,714,798 | B2 * | 5/2010 | Lashmore et al. | 343/897 |
| 2001/0004979 | A1 | 6/2001 | Han et al. | |
| 2002/0160111 | A1 | 10/2002 | Sun et al. | |
| 2003/0004058 | A1 | 1/2003 | Li et al. | |
| 2003/0122111 | A1 | 7/2003 | Glatkowski | |
| 2003/0177450 | A1 | 9/2003 | Nugent | |
| 2003/0200521 | A1 | 10/2003 | DeHon et al. | |
| 2004/0005723 | A1 | 1/2004 | Empedocles et al. | |
| 2004/0007528 | A1 | 1/2004 | Bakajin et al. | |
| 2004/0023253 | A1 | 2/2004 | Kunwar et al. | |
| 2004/0031975 | A1 | 2/2004 | Kern et al. | |
| 2004/0041154 | A1 | 3/2004 | Watanabe et al. | |
| 2004/0043527 | A1 | 3/2004 | Bradley et al. | |
| 2004/0071949 | A1 | 4/2004 | Glatkowski et al. | |
| 2004/0099438 | A1 | 5/2004 | Arthur et al. | |
| 2004/0104129 | A1 | 6/2004 | Gu et al. | |
| 2004/0132070 | A1 | 7/2004 | Star et al. | |
| 2004/0181630 | A1 | 9/2004 | Jaiprakash et al. | |
| 2004/0253167 | A1 | 12/2004 | Silva et al. | |
| 2004/0265550 | A1 | 12/2004 | Glatkowski et al. | |
| 2004/0266106 | A1 | 12/2004 | Lee | |
| 2005/0053525 | A1 | 3/2005 | Segal et al. | |
| 2005/0095938 | A1 | 5/2005 | Rosenberger et al. | |
| 2005/0212014 | A1 | 9/2005 | Horibe et al. | |
| 2006/0237537 | A1 | 10/2006 | Empedocles et al. | |
| 2007/0004191 | A1 | 1/2007 | Gu et al. | |
| 2007/0036709 | A1 * | 2/2007 | Lashmore et al. | 423/447.1 |

FOREIGN PATENT DOCUMENTS

| | | | |
|---|---|---|---|
| JP | 2001/035362 | | 2/2001 |
| JP | 2004/090208 | | 3/2004 |
| WO | WO-98/39250 | A1 | 9/1998 |
| WO | WO-99/65821 | A1 | 12/1999 |
| WO | WO-01/03208 | A1 | 1/2001 |
| WO | WO-02/245113 | A2 | 6/2002 |
| WO | WO-02/248701 | A2 | 6/2002 |
| WO | WO-03/016901 | A1 | 2/2003 |
| WO | WO-03/034142 | A1 | 4/2003 |

OTHER PUBLICATIONS

Brown, K. M. "System in package "The Rebirth of SIP"," 2004 IEEE Custom Integrated Circuits, May 2004, 6 pages.

Crowley, et al., "512 Mb PROM with 8 layers of antifuse/Diode cells," IEEE International Solid-State Circuits Conference, vol. XLVI, Feb. 2003, pp. 284-285.

Cui, et al., "Carbon Nanotube Memory Devices of High Charge," Applied Phys. Ltrs., vol. 81, No. 17, Oct. 2002, pp. 3260-3262.

Fuhrer, et al., "High-Mobility Nanotube Transistor Memory," Nano Letters, vol. 2, No. 7, 2002, pp. 755-759.

Huai, Y., "Spin-Transfet Torque MRAM (STT-MTAM): Challenges and Prospects," AAPS Bulletin, vol. 18, No. 6, Dec. 2008, pp. 33-40.

Jiang, et al., "Performance Breakthrough in 8nm Gate-All-Around Length Gate-All-Around Nanowire Transistors using Metallic Nanowire Contacts," 2008 Symposium on VLSI Technology Digest of Technical Papers, pp. 34-35.

Kianian, et al., "A 3D Stackable Carbon Nanotube-based Nonvolatile Memory (NRAM)," ESSDERC, Nantero Inc., Jun. 14, 2010, 4 pages.

Novak, et al., "Nerve Agent Using Networks of Single-Walled Carbon Nanotubes," Appl. Phys. Ltrs., vol. 83, No. 19, Nov. 2003, pp. 4026-4028.

Servalli, G., "A 45nm Generation Phase Change Memory Technology," IEDM 2009 Technical Digest, pp. 5.7.1-5.7.4.

Snow, et al., "Random Networks of Carbon Nanotubes as an Electronic Material," App. Phys. Ltrs., vol. 82, No. 13, Mar. 2003, pp. 2145-2147.

Star, et al., "Nanoelectronic Carbon Dioxide Sensors," Adv. Mater., vol. 16, No. 22, 2004, pp. 2049-2052.

Star, et al., "Nanotube Optoelectronic Memory Devices," Nano Letters, vol. 4, No. 9, 2004, pp. 1587-1591.

Zhou, et al., "p-Channel, n-Channel Thin Film Transistors and p-n Diodes Based on Single Wall Carbon Nanotube Networks," Nano Letters, vol. 4, No. 10, 2004, pp. 2031-2035.

Ago et al., "Workfunction of Purified and Oxidised Carbon Nanotubes," Synthetic Metals, vol. 103, pp. 2494-2495, 1999.

Ajayan, P. M. et al., "Applications of Carbon Nanotubes", Carbon Nanotubes, vol. 80, pp. 391-425, 2001.

Ajayan, et al., "Nanometre-Size Tubes of Carbon, "Rep. Prog. Phys., 60, 1997, pp. 1025-1062.

Banerjee et al., "Functionalization of Carbon Nanotubes with a Metal-Containing Molecular Complex," Nano Letters, vol. 2, No. 1, pp. 49-53, 2002.

Berhan, L. et al., "Mechanical properties of nanotube sheets: Alterations in joint morphology and achievable moduli in manufacturable materials", Journal of Applied Physics, vol. 95, No. 8, pp. 4335-4345, Apr. 15, 2004.

Berber, et al., "Unusually High Thermal Conductivity of Carbon Nanotubes," Physical Review Letters, vol. 84, No. 20, May 2000, pp. 4613-4616.

Bonard, J. M. et al., "Monodisperse Multiwall Carbon Nanotubes Obtained with Ferritin as Catalyst", Nano Letters, vol. 2, No. 6, pp. 665-667, 2002.

Cassell, A. M. et al., "Large Scale CVD Synthesis of Single-Walled Carbon Nanotubes", J. Phys. Chem. B, pp. 6484-6492, 1999.

Chen, B. et al., "Heterogeneous Single-Walled Carbon Nanotbue Catalyst Discovery and Optimization", Chem. Mater., vol. 14, pp. 1891-1896, 2002.

Cheng, H M., "Large-scale and low-cost synthesis of single-walled carbon nanotubes by the catalytic pyrolysis of hydrocarbons", Applied Physics Letters, vol. 72, No. 25, pp. 3282-3284, Jun. 22, 1998.

Chiang, et al., Purification and Characterization of Single-Wall Carbon Nanotubes (SWNTs) Obtained from the Gas-Phase Decomposition of CO (HiPco Process), J. Phys. Chem. B, vol. 105, pp. 1157-1161, 2001.

Dai, H. et al., "Controlled Chemical Routes to Nanotube Artchitectures, Physics, and Devices", J. Phys. Chem. B, vol. 103, pp. 11246-11255, 1999.

Delzeit et al., "Multilayered metal catalysts for controlling the density of single-walled carbon nanotube growth," Chemical Physics letters, vol. 348, pp. 368-374, Nov. 16, 2001.

Desai et al., "Freestanding Carbon Nanotube Specific Fabrication", *Proc. of 2005, 5th IEEE Conf., Nanotech*, Nagoya, Japan, pp. 1-4, Jul. 2005.

Franklin, N. R. et al., "An Enhanced CVD Approach to Extensive Nanotube Networks with Directionality", Advanced Materials, 5 pages, 2000.

Haddon et al.,"Purification and Separation of Carbon Nanotubes," *MRS Bulletin*, , pp. 252-259, Apr. 2004.

Hafner, J. H. et al., "Catalytic growth of single-wall carbon nanotubes from metal particles", Chemical Physics Letters, vol. 296, pp. 195-202, Oct. 30, 1998.

Homma, Y. et al., "Single Walled Carbon Nanotube Growth on Silicon Substrates Using Nanoparticle Catalysts", Jpn. J. Appl. Phys., vol. 41, Pt. 2, No. 1A/B, pp. L89-L91, 2002.

(56) References Cited

OTHER PUBLICATIONS

International Search Authority, International Search Report for PCT/US2005/045316 mailed Sep. 6, 2006, 2 pages.
International Search Report and Written Opinion for International Patent Application PCT/US05/18467, mailed Oct. 1, 2007, 5 pages.
International Search Report, International Searching Authority, for International Application PCT/US05/18539, mailed Sep. 18, 2006, 4 pages.
Jeong et al., "A new purification method of single-wall carbon nanotubes using H2S and 02 mixture gas," Chemical Physics Letters, vol. 344, pp. 18-22, Aug. 17, 2001.
Joselevich, E., "Vectorial Growth of Metallic and Semiconducting Single-Wall Carbon Nanotubes", Nano Letters, vol. 0, No. 0, pp. A-E, 2002.
Khan et al, "Solubilization of Oxidized Single-Walled Carbon Nanotubes in Organic and aqueous Solvents through Organic Derivatization," Nano Letters, vol. 2, No. 11, pp. 1215-1218, 2002.
Kong, J. et al., "Chemical vapor deposition of methane for single-walled carbon nanotubes", Chemical Physics Letters, pp. 567-574, Aug. 14, 1998.
Kong, J. et al., "Nanotube Molecular Wires as Chemical Sensors," Science, 2000, vol. 287 pp. 622-625.
Li, J. et al., "Carbon Nanotube Nanoelectrode Array for Ultrasensitive DNA Detection", Nano Letters, vol. 3, No. 5, pp. 597-602, 2003.
Li, Y. et al., "Growth of Single-Walled Carbon Nanotubes from Discrete Catalytic Nanoparticles of Various Sizes", J. Phys. Chem. B, vol. 105, pp. 11424-11431, 2001.
Li, Y. et al., "Preparation of Monodispersed Fe-Mo Nanoparticles as the Catalyst for CVD Synthesis of Carbon Nanotubes", Chem. Mater., vol. 13. pp. 1008-1014, 2001.
Nerushev, O. A., et al., "Carbon nanotube films obtained by thermal chemical vapour deposition", J. Mater. Chem., vol. 11, pp. 1122-1132, 2001.
Niu, Chunming et al., "High Power Electrochemical Capacitors Based on Carbon Nanotube Electrodes," Appl. Phys. Lett. 70(11), Mar. 17, 1997, pp. 1480-1482.
Onoa et al., "Bulk Production of singly dispersed carbon nanotubes with prescriped lengths", *Nanotechnology*, vol. 16, pp. 2799-2803, 2005.
Parikh, K. et al., "Flexible vapour sensors using single walled carbon nanotubes", Sensors and Actuators B, vol. 113, pp. 55-63, 2006.
Peigney, M. et al., "A Study of the Formation of Single- and Double-Walled Carbon Nanotubes by a CVD Method", J. Phys. Chem. B., vol. 105, pp. 9699-9710, 2001.
Qi, P. et al., "Toward Large Arrays of Multiplex Functionalized Carbon Nanotube Sensors for Highly Sensitive and Selective Molecular Detection," *Nano. Lett.* 2003, vol. 3(3), pp. 347-351.
Shelimov et al., "Purification of single-wall carbon nanotubes by ultrasonically assisted filtration," Chemical Physics Letters, vol. 282, pp. 429-434, Jan. 23, 1998.
Sotiropoulou, S. et al., "Carbon nanotube array-based biosensor", Anal. Bioanal. Chem, vol. 375, pp. 103-105, 2003.
Valentini, L. et al., "Sensors for Sub-ppm NO2 Gas Detection Based on Carbon Nanotube Thin Films," *Applied Physics Letters*, 2003, vol. 82(6), pp. 961-963.
Wang, et al., "Receiving and Transmitting Light-Like Radio Waves: Antenna Effect in Arrays of Aligned Carbon Nanotubes," Applied Physics Letters, vol. 85, No. 13, Sep. 2004, pp. 2607-2609.
Yao, et al., "High-Field Electrical Transport in Single-Wall Carbon Nanotubes," Physical Review Letters, vol. 84, No. 13, Mar. 2000, pp. 2941-2944.
Zhang et al., "Formation of metal nanowires on suspened single-walled carbon nanotubes", Appl. Phys. Lett., vol. 77, p. 3015-3017, Nov. 2000.
Zhang, Y. et al., "Metal coating on suspended carbon Nanotubes and its implication to metal-tube interaction", Chemical Physics Letters, vol. 331, pp. 35-41, 2000.
Zhang, Z. et al.,"Select Pathways to Carbon Nanotube Film Growth", Advanced Materials, 4 pages, Jun. 19, 2001.
Zhao, Y. P. et al., Frequency-dependent electrical transport in carbon nanotubes, Physical Review B., vol. 64, pp. 201402-1 to 201402-4, 2001.

* cited by examiner

MICROSTRIP ANTENNA ELEMENTS AND ARRAYS COMPRISING A SHAPED NANOTUBE FABRIC LAYER AND INTEGRATED TWO TERMINAL NANOTUBE SELECT DEVICES

TECHNICAL FIELD

The present disclosure relates to microstrip antenna elements and arrays, and more particularly to microstrip antenna elements and arrays comprising a shaped nanotube fabric layer used as a radiating structure.

CROSS-REFERENCE TO RELATED APPLICATIONS

This application is related to the following U.S. patents, which are assigned to the assignee of the present application, and are hereby incorporated by reference in their entirety:

Methods of Nanotube Films and Articles (U.S. Pat. No. 6,835,591), filed Apr. 23, 2002;

Methods of Using Pre-Formed Nanotubes to Make Carbon Nanotube Films, Layers, Fabrics, Ribbons, Elements, and Articles (U.S. Pat. No. 7,335,395), filed Jan. 13, 2003;

Devices Having Horizontally-Disposed Nanofabric Articles and Methods of Making the Same (U.S. Pat. No. 7,259,410), filed Feb. 11, 2004;

Non-Volatile Electromechanical Field Effect Devices and Circuits Using Same and Methods of Forming Same (U.S. Pat. No. 7,115,901), filed Jun. 9, 2004;

Patterned Nanowire Articles on a substrate and Methods of Making Same (U.S. Pat. No. 7,416,993), filed Sep. 8, 2004;

Devices Having Vertically-Disposed Nanofabric Articles and Methods of Making Same (U.S. Pat. No. 6,924,538), filed Feb. 11, 2004.

This application is related to the following patent applications, which are assigned to the assignee of the application, and are hereby incorporated by reference in their entirety:

Methods of Making Carbon Nanotube Films, Layers, Fabrics, Ribbons, Elements, and Articles (U.S. patent application Ser. No. 10/341,005), filed Jan. 13, 2003;

High Purity Nanotube Fabrics and Films (U.S. patent application Ser. No. 10/860,332), filed Jun. 3, 2004;

Two-Terminal Nanotube Devices and Systems and Methods of Making Same (U.S. patent application Ser. No. 11/280,786), filed Nov. 15, 2005;

Nanotube Articles with Adjustable Electrical Conductivity and Methods of Making Same (U.S. patent application Ser. No. 11/398,126), filed Apr. 5, 2006;

Anisotropic Nanotube Fabric Layers and Films and Methods of Fowling Same (U.S. patent application No. not yet assigned) filed on even date herewith; and Anisotropic Nanotube Fabric Layers and Films and Methods of Forming Same (U.S. patent application No. not yet assigned) filed on even date herewith.

BACKGROUND

Any discussion of the related art throughout this specification should in no way be considered as an admission that such art is widely known or forms part of the common general knowledge in the field.

Antennas are attractive for many commercial and government applications. Antennas include a conductive material layer (a radiating structure) which can send and receive electromagnetic radiation by the acceleration of electrons. Sophisticated antenna technology and designs are required to control the transmitted pattern of said electromagnetic radiation. The geometry of the antenna can be controlled to focus the energy that is either transmitted or received by the antenna in a specific direction, i.e., the antenna's gain. Several important parameters (figures of merit) that are utilized for the design and application of antennas are radiation power density and intensity, directivity, beamwidth, efficiency, beam efficiency, bandwidth, polarization, and gain. Current antenna technology varies widely and the designs of modern antennas are specifically tailored depending on the figures of merit for the antenna application.

Microstrip antenna elements and arrays (sometimes termed microstrip patch antennas or printed antennas) are used within a plurality of electronic devices and systems and are well known to those skilled in the art. There exists an increasing demand for microstrip antenna elements and arrays of such elements in the design of a plurality of portable electronic devices—such as, but not limited to, GPS receivers, satellite radios, cellular telephones, and laptop computers. Microstrip antenna elements and arrays are favorable in such applications due to their low cost, low profile, low weight, high durability, and ease of fabrication as compared with other types of antenna structures. Microstrip antenna elements also can be easily fabricated to conform to a curved surface—such as, but not limited to, the nose cone of an aircraft or the interior of the shaped case of a portable electronic device. However, as the physical dimensions of a microstrip antenna element are inversely proportional to the resonant frequency of said element—that is, the size of the microstrip antenna will determine the "center frequency" at which the device is most sensitive—microstrip antennas are typically used to transmit and receive UHF frequencies and higher (that is, at frequencies greater than 300 MHz).

A typical microstrip antenna element is comprised of a plurality of coplanar layers, including a shaped conductive material layer which forms a radiating structure, an intermediate dielectric layer, and a ground plane layer. The radiating structure is formed of an electrically conductive material (such as, but not limited to, copper or gold) embedded or photoetched on the intermediate dielectric layer with a specific geometry and is generally exposed to free space. The microstrip antenna element generally radiates in a direction substantially perpendicular to the ground plane layer. However, arrays of microstrip antenna elements can be employed to achieve much higher gains and directivity than would be possible with a single microstrip antenna element.

FIG. 1A illustrates a typical rectangular microstrip antenna element. Rectangular microstrip antenna elements (as depicted in FIG. 1A) are most commonly used in electronic devices and systems, however microstrip antenna elements can be formed into any continuous shape as befits the needs of a specific application. The shape, physical dimensions, and orientation of a microstrip antenna element define parameters such as, but not limited to, resonant frequency, bandwidth, input impedance, and directivity. The design of microstrip antenna elements with respect to these parameters is well known to those skilled in the art.

Referring now to FIG. 1A, an insulating dielectric substrate layer 110 (with a layer height "H") is deposited over a conductive layer 120. A shaped conductive trace 101 is further deposited over dielectric substrate layer 110. Shaped conductive trace 101 comprises a rectangular radiating structure 101*a* with a length "L," a width "W," and a thickness "T" and a transmission line element 101*b*. The conductive layer 120 forms a ground plane below the shaped conductive trace 101, with the dielectric substrate layer 110 providing electrical isolation between said ground plane and radiating structure 101*a*.

FIG. 1B illustrates a typical rounded microstrip antenna element. As with the rectangular microstrip antenna element depicted in FIG. 1A, an insulating dielectric substrate layer 130 (with a layer height "H") is deposited over a conductive layer 140. A shaped conductive trace 102 is further deposited over dielectric substrate layer 130. Shaped conductive trace 102 comprises a rounded radiating structure 102*a* with a thickness "T" and a transmission line element 102*b*. The conductive layer 140 forms a ground plane below the shaped conductive trace 102, with the dielectric substrate layer 130 providing electrical isolation between said ground plane and shaped radiating structure 102*a*.

The height "H" of the dielectric substrate layer is typically not a critical design parameter, but in general the height "H" is limited to a dimension much smaller than the wavelength of operation. That is, $H<<1/f_c$, where $f_c$ is the resonant (or center) frequency of the antenna element. The dielectric constant "$\in_r$" (often termed permittivity by those skilled in the art) of the dielectric substrate layer (110 in FIG. 1A, 130 in FIG. 1B) is a more critical design parameter, as the degree to which the dielectric substrate layer (110 in FIG. 1A, 130 in FIG. 1B) impedes an electric field created between a radiating structure (101*a* in FIG. 1A, 102*a* in FIG. 1B) and a ground plane (conductive layer 120 in FIG. 1A, conductive layer 140 in FIG. 1B) will affect properties of the antenna element such as, but not limited to, resonant frequency and bandwidth. In some designs, an antenna element is simply suspended in open air above a ground plane in order to maximize the bandwidth of the microstrip antenna assembly. This, however, results in a device which is significantly more difficult to fabricate and less robust.

FIG. 2 is an electric field diagram illustrating the basic operation of a typical microstrip antenna element. An electric field is induced between radiating structure 201 (corresponding to rectangular radiating structure 101*a* in FIG. 1A) and ground plane 220 (corresponding to conductive layer 120 in FIG. 1A), indicated by electric field lines 230. This electric field is either induced through a local stimulus wherein an electrical signal is provided to radiating structure 201 through a local transmission line (that is, the microstrip antenna is used to transmit an electrical signal), or through a remote stimulus wherein radiating structure 201 is responsive to an ambient electrical signal broadcast from another electrical device (that is, the microstrip antenna element is used to receive an electrical signal).

The electric field diagram of FIG. 2 also illustrates how this electric field passes through dielectric substrate layer 210 (corresponding to dielectric substrate layer 110 in FIG. 1A), with the electric field strength at a minimum at the center of radiating structure 201 and at a maximum at the edges of radiating structure 201. These areas of maximum electric field strength (along the radiating edges of radiating structure 201) are termed the "fringing field" by those skilled in the art. The field lines of this electric field—and, by extension, the resonant frequency of the microstrip antenna element—is determined (for the most part) by the length of radiating structure 201 and the dielectric constant (or permittivity) "$\in_r$" of dielectric substrate layer 210. The detailed methods and parameters for designing and fabricating microstrip antennas such as are illustrated in FIGS. 1A, 1B, and 2 are well known to those skilled in the art.

Previously known microstrip antenna elements are formed by providing a shaped conductive metal trace (typically copper or gold) over a dielectric substrate through industry standard lithographic techniques. However, in recent years novel methods and techniques have been introduced for forming and shaping nanotube fabric layers and films over various substrates. These nanotube fabric layers and films are conductive and can be etched (or in some cases directly formed) into specific predetermined geometries over a plurality of dielectric substances.

As described in the incorporated references, nanotube elements can be applied to a surface of a substrate through a plurality of techniques including, but not limited to, spin coating, dip coating, aerosol application, or chemical vapor deposition (CVD). Ribbons, belts, or traces made from a matted layer of nanotubes or a non-woven fabric of nanotubes can be used as electrically conductive elements. The patterned fabrics disclosed herein are referred to as traces or electrically conductive articles. In some instances, the ribbons are suspended, and in other instances they are disposed on a substrate. Numerous other applications for patterned nanotubes and patterned nanotube fabrics include, but are not limited to: memory applications, sensor applications, and photonic uses. The nanotube belt structures are believed to be easier to build at the desired levels of integration and scale (of number of devices made) and the geometries are more easily controlled. The nanotube ribbons are believed to be able to more easily carry high current densities without suffering the problems commonly experienced or expected with metal traces.

Properties of the nanotube fabric can be controlled through deposition techniques. Once deposited, the nanotube fabric layers can be patterned and converted to generate insulating fabrics.

Monolayer nanotube fabrics can be achieved through specific control of growth or application density. More nanotubes can be applied to a surface to generate thicker fabrics with less porosity. Such thick layers, up to a micron or greater, may be advantageous for applications which require lower resistance.

SUMMARY OF THE DISCLOSURE

The current invention relates to nanotube based antennas for the reception and transmission of electromagnetic radiation signals. More specifically, the invention relates to the creation of a wide variety of antennas based on nanotube fabric layers and films including, but not limited to, microstrip antennas and reconfigurable antenna arrays.

In particular, the present disclosure provides an antenna element comprising a ground plane layer, a dielectric substrate layer deposited over the ground plane layer, and a shaped nanotube fabric layer deposited over the dielectric substrate layer. The shaped nanotube fabric layer comprises a shaped radiating structure and a transmission line element.

The present disclosure also provides an antenna element comprising a ground plane layer, a dielectric substrate layer deposited over the ground plane layer, at least two electrode elements deposited over the dielectric substrate layer, and a shaped nanotube fabric layer deposited over the dielectric substrate layer. The shaped nanotube fabric layer comprises a shaped radiating structure and a transmission line element, wherein the transmission line element overlies at least two electrode elements to form a nanotube select device.

The present disclosure also provides an antenna array comprising a ground plane layer, a dielectric substrate layer deposited over the ground plane layer, and a shaped nanotube fabric layer deposited over the dielectric substrate layer. The shaped nanotube fabric layer comprises a plurality of shaped radiating structures and a plurality of transmission line elements.

The present disclosure also provides an antenna array comprising a ground plane layer, a dielectric substrate layer deposited over the ground plane layer, at least two electrode elements deposited over the dielectric substrate layer, and a shaped nanotube fabric layer deposited over the dielectric substrate layer. The shaped nanotube fabric layer comprises a plurality of shaped radiating structures and a plurality of transmission line elements, wherein at least one of the plurality of transmission line elements overlies at least two electrode elements to form at least one nanotube select device.

According to one aspect of this disclosure, an antenna is fabricated by using a nanotube fabric layer.

Under another aspect of this disclosure, the nanotube based antenna is horizontally disposed.

Under another aspect of this disclosure, the nanotube based antenna is vertically disposed.

Under another aspect of this disclosure, the nanotube based antenna is both horizontally and vertically disposed.

Under another aspect of this disclosure, the nanotube based antenna is a monolayer.

Under another aspect of this disclosure, the nanotube based antenna is a multilayered fabric.

Under another aspect of this disclosure, the nanotube based antenna is optically transparent.

Under another aspect of this disclosure, the nanotube based antenna is suspended.

Under another aspect of this disclosure, the nanotube based antenna is conformal to a substrate.

Under another aspect of this disclosure, the nanotube based antenna is spin-coated on a substrate.

Under another aspect of this disclosure, the nanotube based antenna is spray-coated on a surface.

Under another aspect of this disclosure, the nanotube based antenna is disposed on an insulating substrate.

Under another aspect of this disclosure, the nanotube based antenna is deposited on a flexible surface.

Under another aspect of this disclosure, the nanotube based antenna is deposited on a rigid surface.

Under another aspect of this disclosure, the nanotube based antenna is a microstrip antenna.

Under another aspect of this disclosure, the nanotube based antenna is patterned to create a wide variety of antenna structures.

Under another aspect of this disclosure, a plurality of nanotube based antennas are used to create an array of such antennas on a substrate.

Under another aspect of this disclosure, the nanotube based antenna is patterned to create a fractal antenna design.

Under another aspect of this disclosure, the nanotube based antenna is connected to a memory switch to construct a reconfigurable antenna array.

Under another aspect of this disclosure, the memory switch comprises an integrated two terminal nanotube switch.

Other features and advantages of the present disclosure will become apparent from the following description of the disclosure which is provided below in relation to the accompanying drawings.

BRIEF DESCRIPTION OF THE DRAWINGS

The following detailed description will be more readily understood in conjunction with the accompanying drawings, in which like reference characters refer to like parts throughout, and in which.

DETAILED DESCRIPTION

Figure 1A:
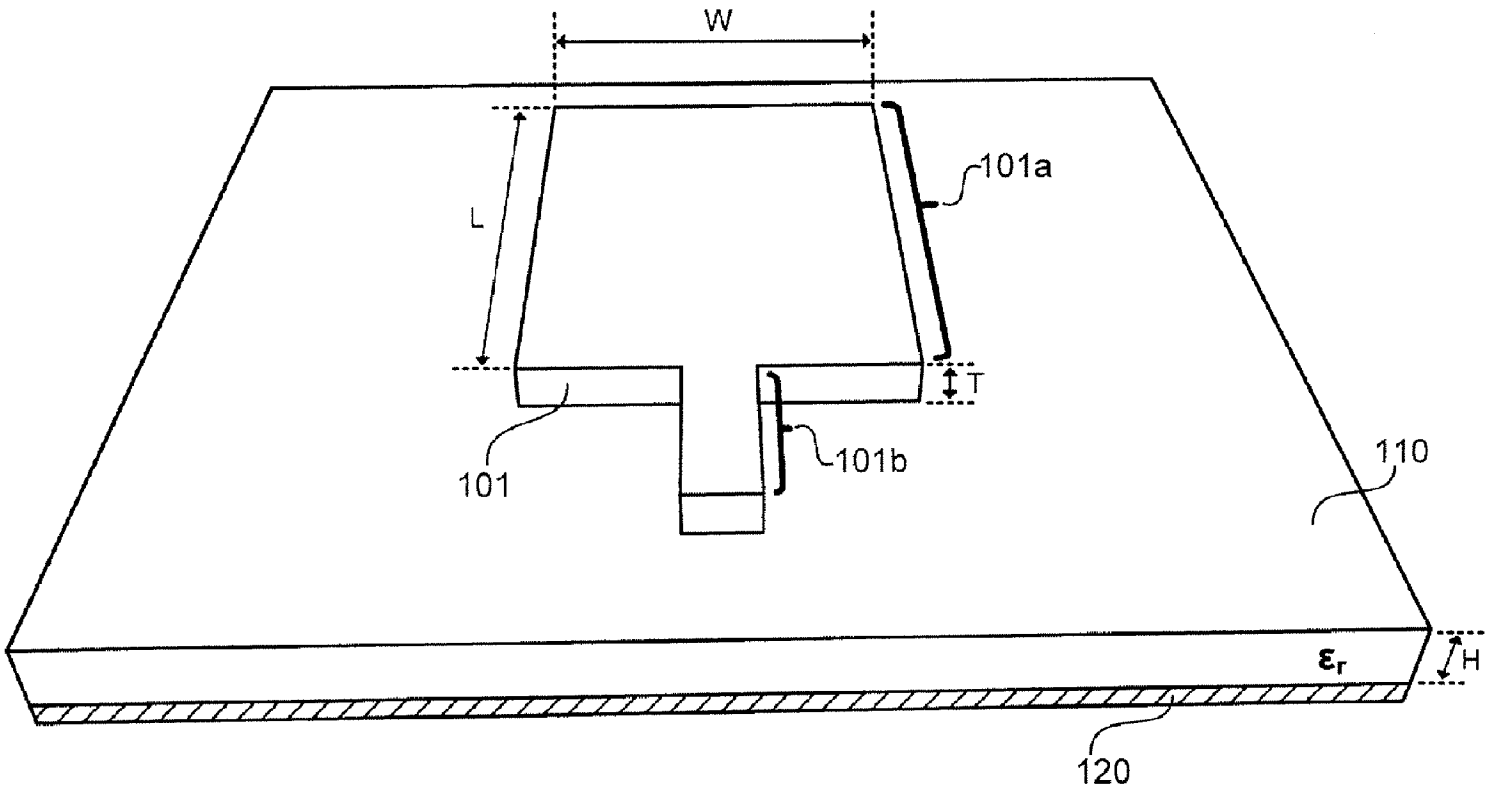
Prior Art FIG. 1A
FIG. 1A is a perspective drawing illustrating the structure of a typical rectangular microstrip antenna element.
Figure 1B:
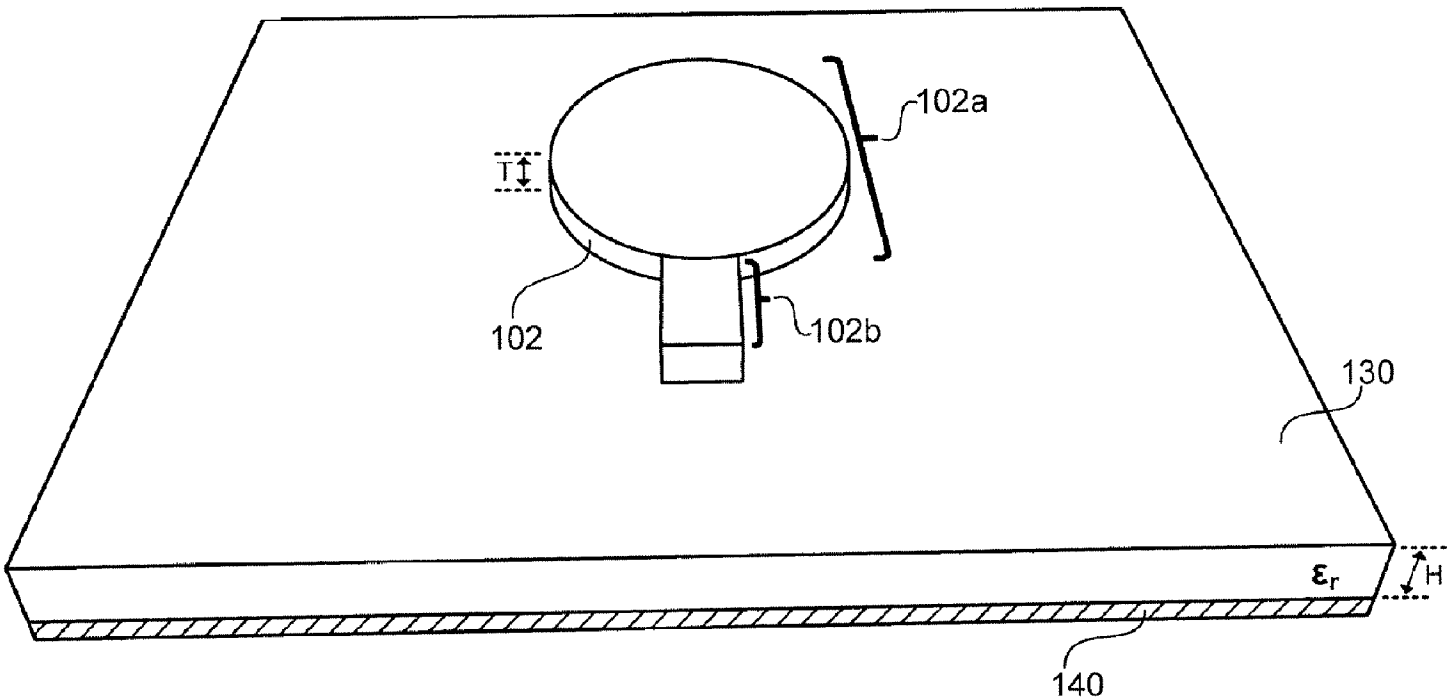
FIG. 1B Prior Art
FIG. 1B is a perspective drawing illustrating the structure of a typical rounded microstrip antenna element.
Figure 2:
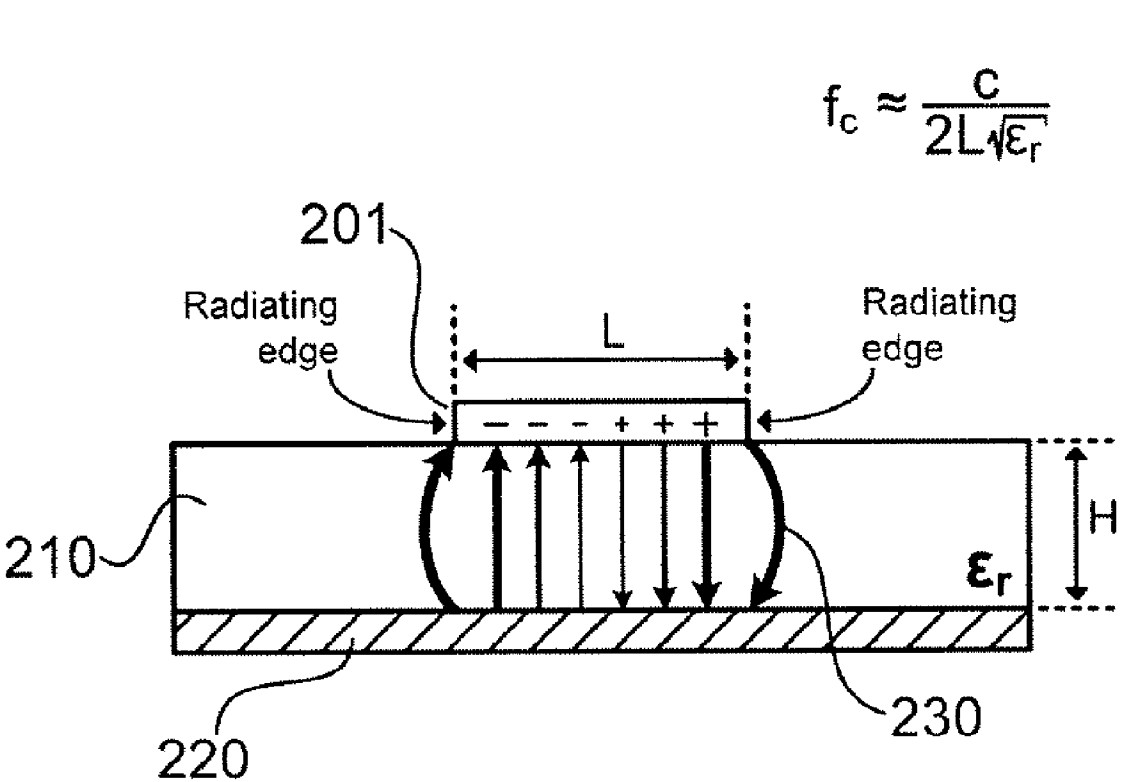
FIG. 2 Prior Art
FIG. 2 is a diagram illustrating the general operation of a typical microstrip antenna element.

The present disclosure involves the creation of antennas, antenna arrays, and reconfigurable antennas from nanotube fabric layers and films.

As will be shown in the following discussion of the present disclosure, nanotube based antennas can be fabricated as stand-alone antennas, flexible antennas applied (or integrated) into other products, or they can be integrated directly in microelectronics devices. Stand alone antennas are fabricated in the field through an application process (for example a spray process) and have many different applications including, but not limited to, remote communications, field deployable antennas, and covert communications. Flexible nanotube based antennas are developed on many different substrates and can be applied to standard products for high performance wireless or communications applications. Nanotube based antennas also may be directly integrated into microelectronics devices (including RF chips), enabling low power devices, high performance, and reconfigurable antennas. Nanotube based antennas also may be used for dual-band dipole antennas. Additionally, new types of secure communications are possible by modulating the antenna and therefore obtaining frequency responses not available with other antennas.

Nanotube based antennas can be fabricated by spin coating or spray coating and the as-produced nanotube fabric layers are conformal to various substrates and can be used for a roll-to-roll process. Various nanotube based antenna applications can be realized such as antenna arrays and if used in conjunction with NRAM switches, reconfigurable nanotube antenna arrays can be constructed. See Y. Wang, K. Kempa, B. Kimball, J. B. Carlson, G. Benham, W. Z. Li, T. Kempa, J. Rybczynski, A. Herczynski and Z. F. Ren, "Receiving and transmitting light-like radio waves: Antenna effect in arrays of aligned carbon nanotubes," Applied Physics Letters, 85(13), 2607-2609, 2004.

Under certain embodiments of the disclosure, electrically conductive articles may be made from a nanotube fabric, layer, or film. Carbon nanotubes with tube diameters as little as 1 nm are electrical conductors that are able to carry extremely high current densities, see, e.g., Z. Yao, C. L. Kane, C. Dekker, Phys. Rev. Lett. 84, 2941 (2000). They also have the highest known heat conductivity, see, e.g., S. Berber, Y.-K. Kwon, D. Tomanek, Phys. Rev. Lett. 84, 4613 (2000), and are thermally and chemically stable, see, e.g., P. M. Ajayan, T. W. Ebbesen, Rep. Prog. Phys. 60, 1025 (1997).

The nanotube antenna of certain embodiments is formed from a non-woven fabric of entangled or matted nanotubes. The switching parameters of the fabric resemble those of individual nanotubes. Thus, the predicted switching times and voltages of the fabric should approximate the same times and voltages of nanotubes. Unlike the nanotube manufacturing which relies on directed growth or chemical self-assembly of individual nanotubes, preferred embodiments of the present disclosure utilize fabrication techniques involving thin films and lithography. This method of fabrication lends itself to generation over large surfaces especially wafers of at least six inches. (In contrast, growing individual nanotubes over a distance beyond sub millimeter distances is currently unfeasible.) Therefore, the nanotube fabric is readily conformable to underlying substrates to which they are applied and formed. This property can be helpful for processing and manufacturing of the nanotube antennas. Specifically, the nanotube fabrics can create flexible antennas that can be applied to a variety of surfaces.

An antenna having a nanotube fabric also should exhibit improved electrical performance and fault tolerances over the use of individual nanotubes, by providing a redundancy of conduction pathways contained with the fabric and ribbons. Moreover, the resistances of the fabrics and ribbons should be significantly lower than that for an individual nanotubes, thus, decreasing its impedance, because the fabrics may be made to have larger cross-sectional areas than individual nanotubes. Creating antennas from nanotube fabrics allows the antennas to retain many if not all of the benefits of individual nanotubes. Moreover, antennas made from nanotube fabric have benefits not found in individual nanotubes. For example, since the antennas are composed of many nanotubes in aggregation, the antenna will not fail as the result of a failure or break of an individual nanotube. Instead, there are many alternate paths through which electrons may travel within a given antenna. In effect, an antenna made from nanotube fabric creates its own electrical network of individual nanotubes within the defined antenna, each of which may conduct electrons. Moreover, by using nanotube fabrics, layers, or films, current technology may be used to create such antennas. For further details on nanotube fabrics, please see the following, the entire contents of which are hereby incorporated by reference in their entirety: U.S. patent application Ser. No. 12/030,470 as filed Feb. 13, 2008 and entitled "Hybrid Circuit Having Nanotube Memory Cells;" U.S. patent application Ser. No. 11/111,582 as filed Apr. 21, 2005 and entitled "Nanotube Films and Articles;" and U.S. Pat. No. 7,264,990 as filed Dec. 13, 2004 and entitled "Methods of Nanotube Films and Articles."

Not only are nanotube fabrics excellent conductors, but they are also particularly well-suited to antenna applications. For example, the nanotube fabrics operate at extended frequencies. Conventional antennas can operate in the UHF range. However, a nanotube fabric antenna can operate over a large range of frequencies. The nanotube fabric antenna can be made specifically to operate at a variety of frequencies. For example, the thickness of the nanotube fabric layer can be adjusted—such as, but not limited to, over the range of 1 nm to 1000 nm—to provide operation of the antenna at certain frequencies.

Further, nanotube fabric antennas are transparent to various wavelengths of electromagnetic radiation, such as, but not limited to x-rays. As such, a nanofabric antenna would be x-ray transparent and would provide a measure of frequency control over electromagnetic absorption, which is not possible with a metal based antenna. Further, in some instances, the nanotube fabric antennas can be at least partially optically transparent. For example, if the antenna is optically transparent, the antenna can be placed on a surface and would not be visible to the human eye. Therefore in product development and manufacturing, the antenna can be placed on the outside of a package or product without the antenna being visible to a user of the product.

Figure 3A:
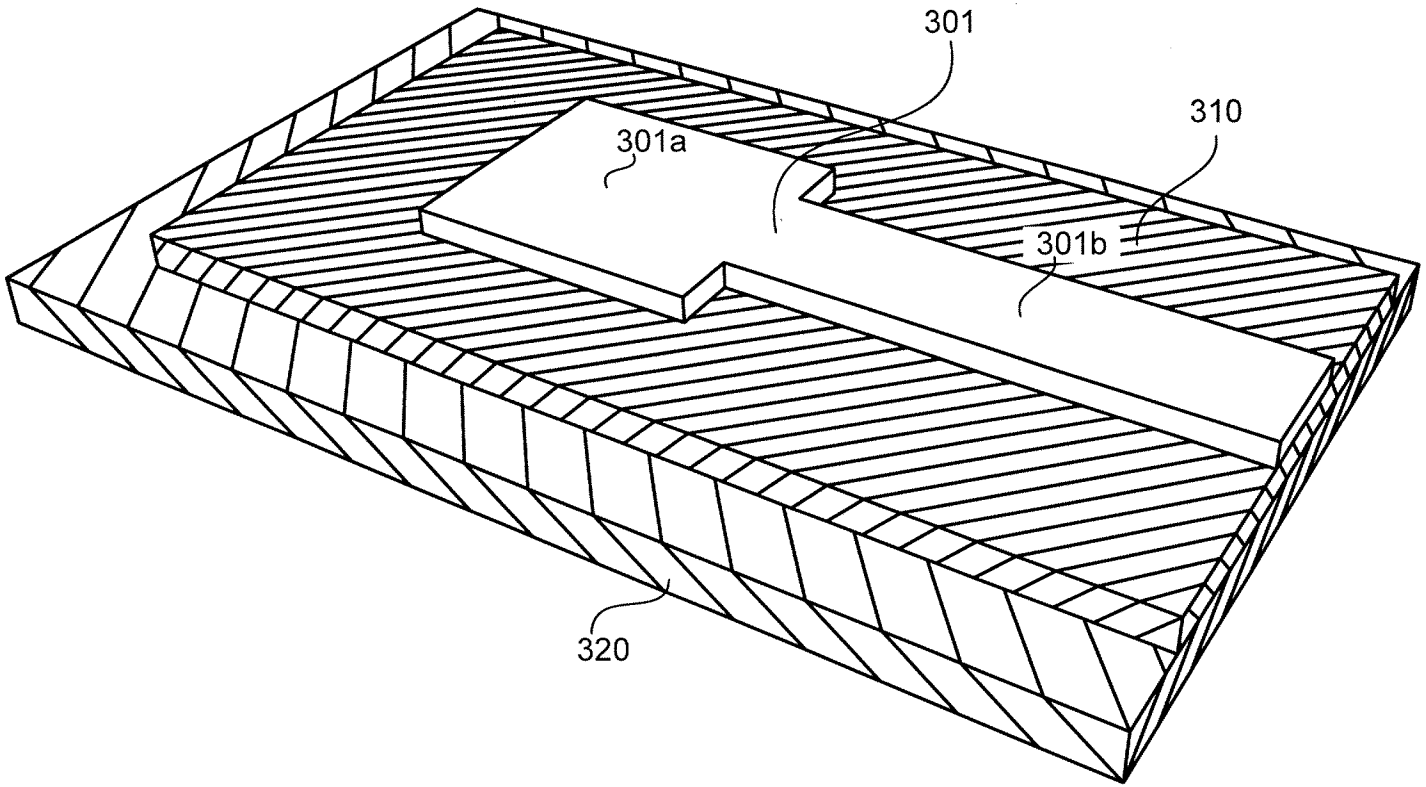
FIG. 3A is a perspective drawing illustrating a rectangular microstrip antenna element according to the methods of the present disclosure.
Figure 3B:
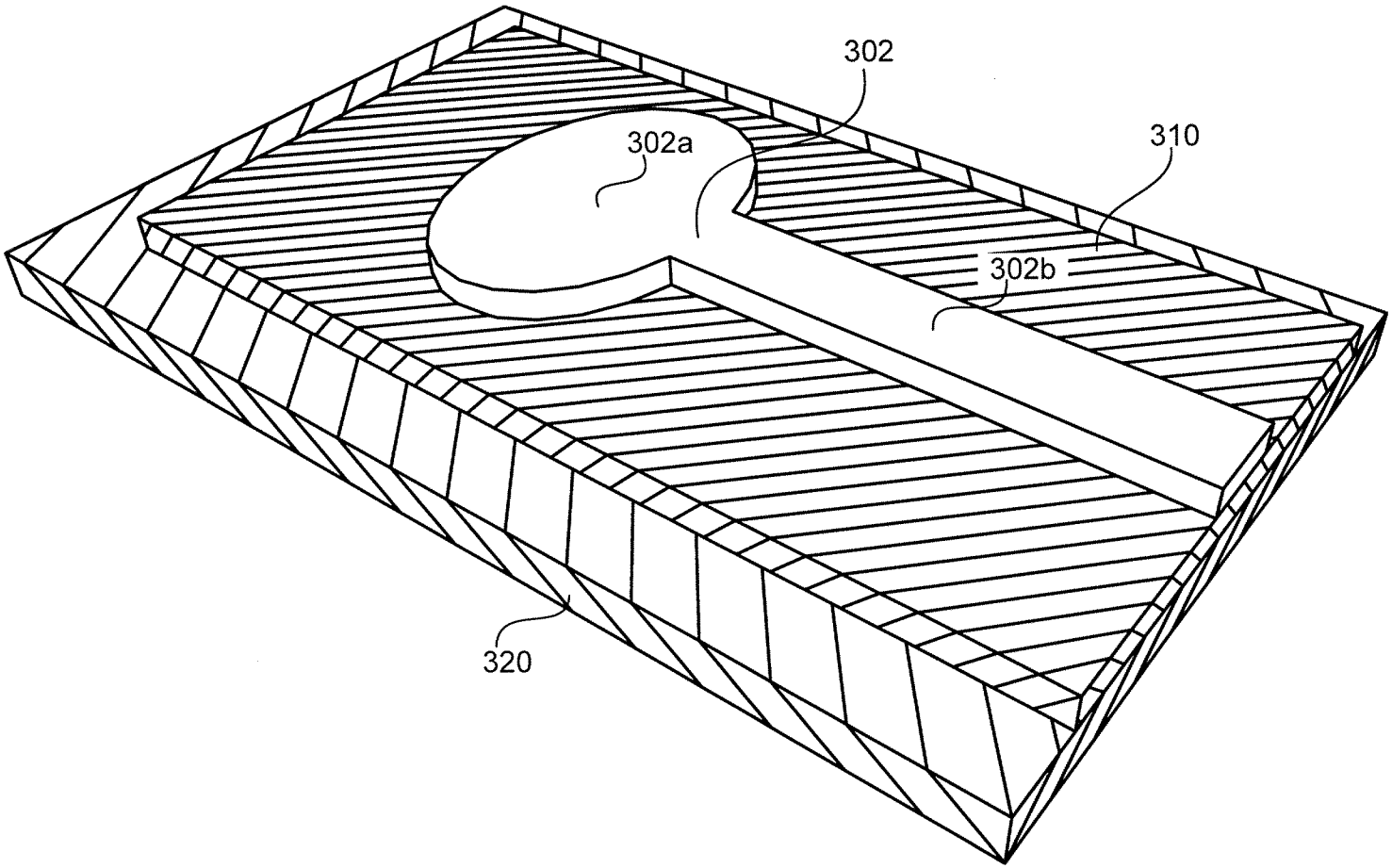
FIG. 3B is a perspective drawing illustrating a rounded microstrip antenna element according to the methods of the present disclosure.
Figure 3C:
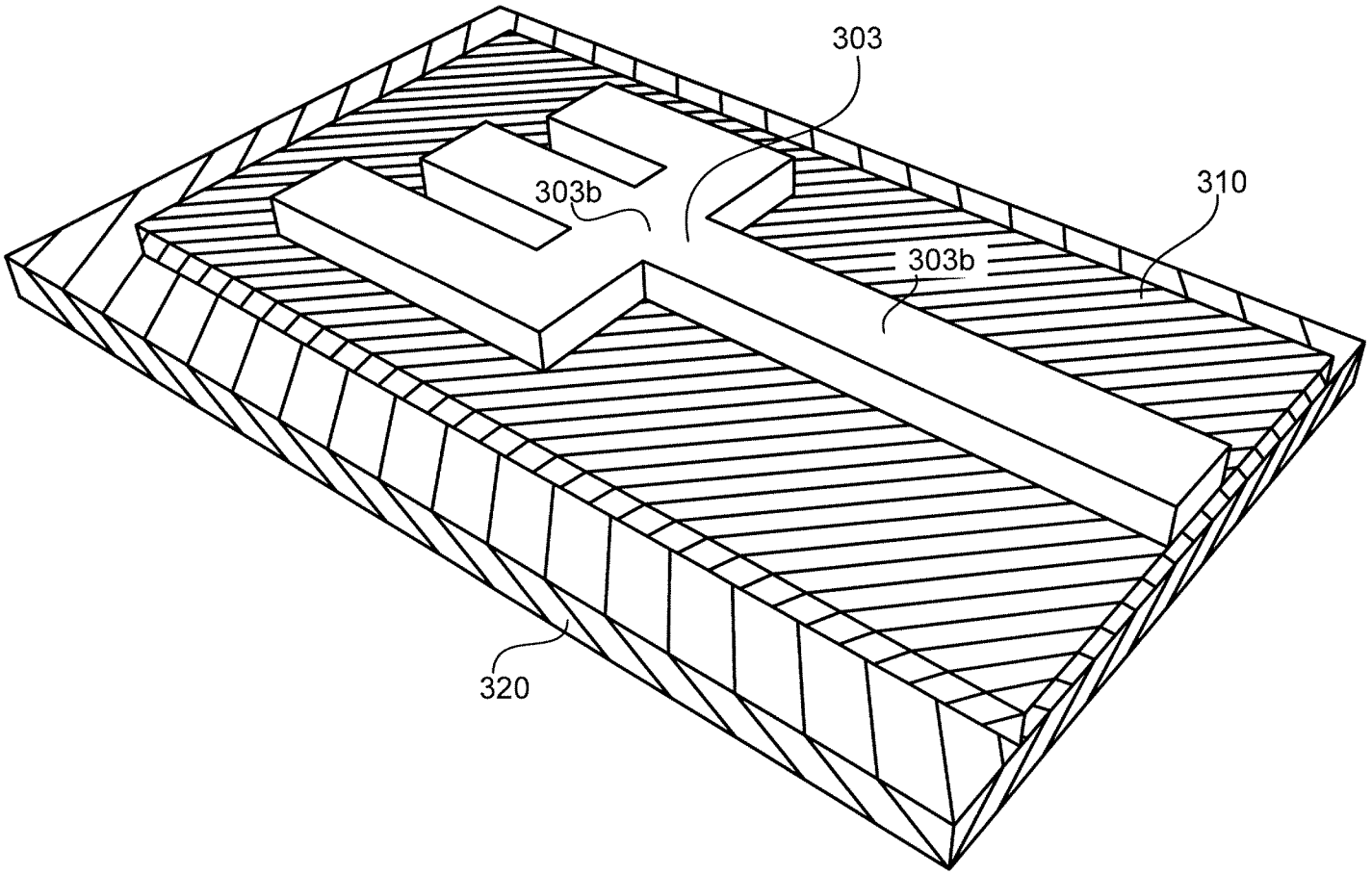
FIG. 3C is a perspective drawing illustrating a microstrip antenna element of relatively complex geometry according to the methods of the present disclosure.

FIGS. 3A-3C illustrate three exemplary microstrip antenna elements according to the methods of the present disclosure. In each example (that is, in each of the exemplary microstrip antenna elements depicted in FIGS. 3A-3C), a dielectric substrate layer 310 is deposited over a ground plane layer 320, and a shaped layer of conductive nanotubes (301 in FIG. 3A, 302 in FIG. 3B, and 303 in FIG. 3C) is deposited over said dielectric substrate layer 310.

FIG. 3A depicts a rectangular microstrip antenna with a shaped conductive nanotube fabric layer 301 comprising rectangular radiating structure 301*a* and transmission line element 301*b*. FIG. 3B depicts a rounded microstrip antenna with the shaped conductive nanotube fabric layer 302 comprising rounded radiating structure 302*a* and transmission line element 302*b*. FIG. 3C depicts a microstrip antenna of complex geometry with the shaped conductive nanotube fabric layer 303 comprising radiating structure 303*a* and transmission line element 303*b*. While FIGS. 3A-3C depict three exemplary microstrip antenna elements with three specific geometries, the methods of the present invention are not limited in this regard. Indeed, the radiating structure of a microstrip antenna element according to the methods of the present disclosure can be formed into any continuous geometry as fits the needs of a specific application including, but not limited to, fractal antenna designs.

A shaped nanotube fabric layer—such as the exemplary shaped nanotube fabric layers depicted in FIGS. 3A-3C (301 in FIG. 3A, 302 in FIG. 3B, and 303 in FIG. 3C) may be provided through a plurality of growth, deposition, and etching techniques. As mentioned previously, techniques for and descriptions of the formation and patterning of nanotube fabric layers are described in detail in the incorporated references.

Figure 4:
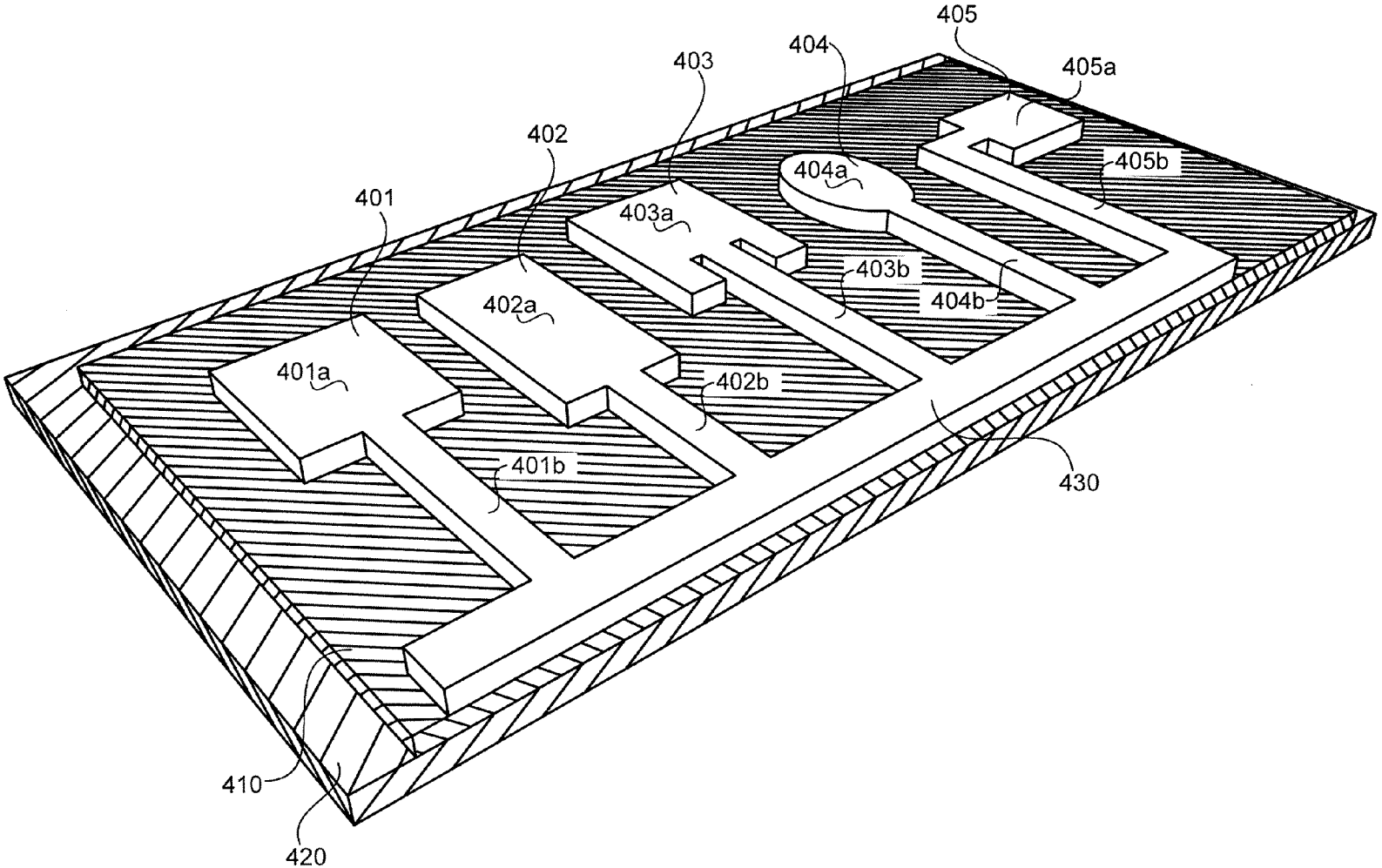
FIG. 4 is a perspective drawing illustrating a microstrip antenna array according to the methods of the present disclosure.

FIG. 4 depicts an exemplary microstrip antenna array according to the methods of the present disclosure. A dielectric substrate layer 410 is deposited over a ground plane layer 420. A continuous nanotube fabric layer 450 is deposited over dielectric substrate layer 410 and is shaped to form a plurality of individual microstrip antenna elements 401-405. Each individual microstrip antenna element 401-405 comprises a shaped radiating structure 401*a*-405*a*, respectively, and a transmission line element 401*b*-405*b*, respectively. The plurality of transmission line elements 401*b*-405*b* are connected to form a node which alternatively provides signals to (in a transmit operation) or is responsive to signals from (in a receive operation) the plurality of the individual microstrip antenna elements 401-405.

Figure 7A:
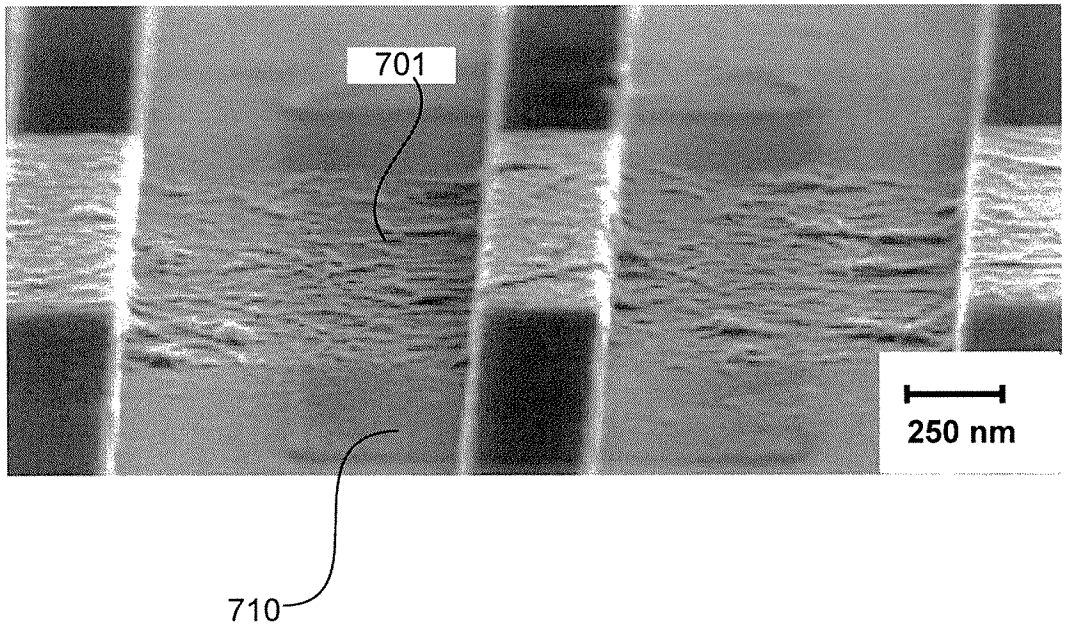
FIGS. 7A-7C are micrographs depicting a vertically deposed nanotube fabric layer.
Figure 7B:
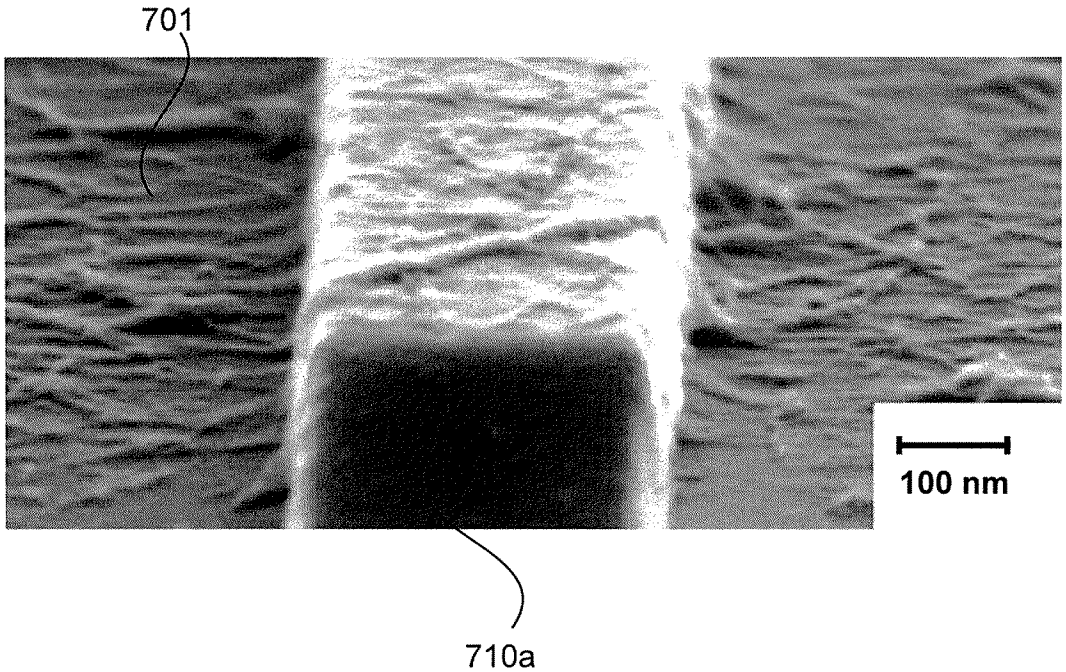
Figure 7C:
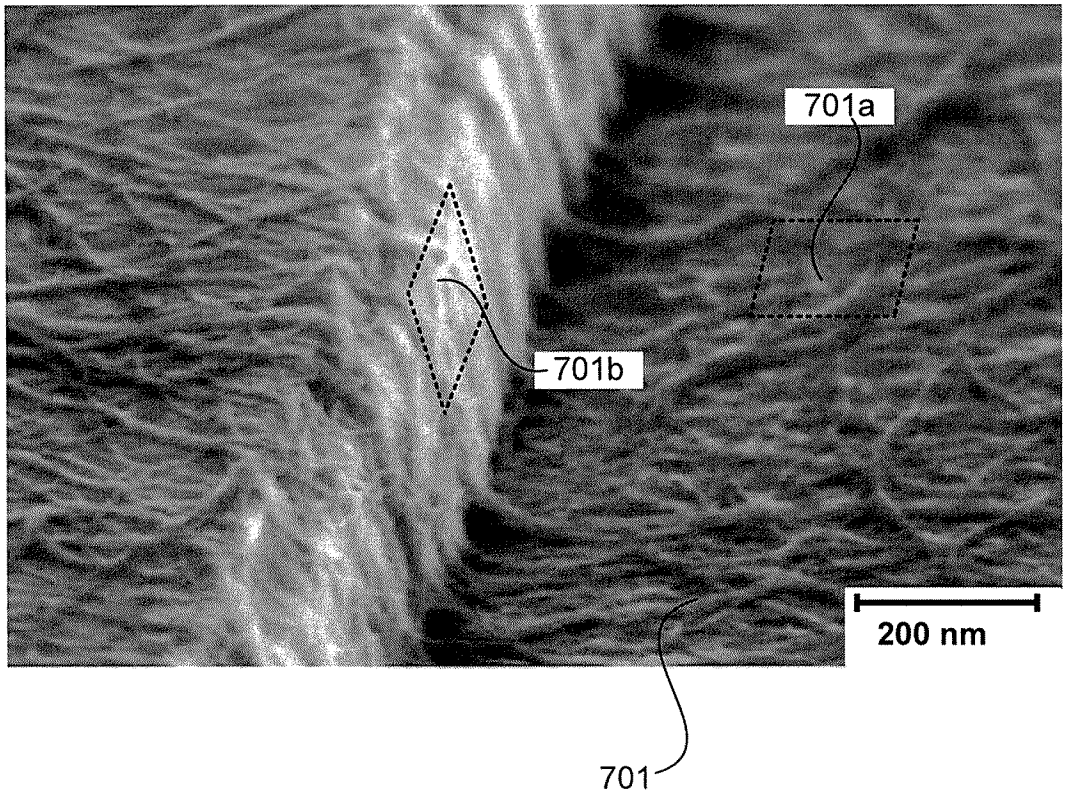

Each of the radiating structures 401*a*-405*a* within the exemplary microstrip antenna array depicted in FIG. 4 is formed into a different geometry, suggesting that each individual microstrip antenna element 401-405 has been designed to respond to a different frequency range (thus providing a microstrip antenna array with an increased frequency range). However, the methods of the present disclosure are not limited in this regard. Indeed, some applications may use a microstrip antenna array comprised of a plurality of substantially identical individual microstrip antenna elements in order to increase the overall gain of the electrical signals received or transmitted through said array. Further, some applications may use a microstrip antenna array having a plurality of individual microstrip antenna elements, in different orientations with respect to each other as to increase the directivity of said array. The flexibility of nanotube fabric layers and films and especially the ability for such fabric layers to conform to a substrate (including, but not limited to, so-called vertical structures as depicted in FIGS. 7A-7C) makes antenna arrays using such nanotube fabric layers and films as radiating structures well suited for such applications.

Figure 5A:
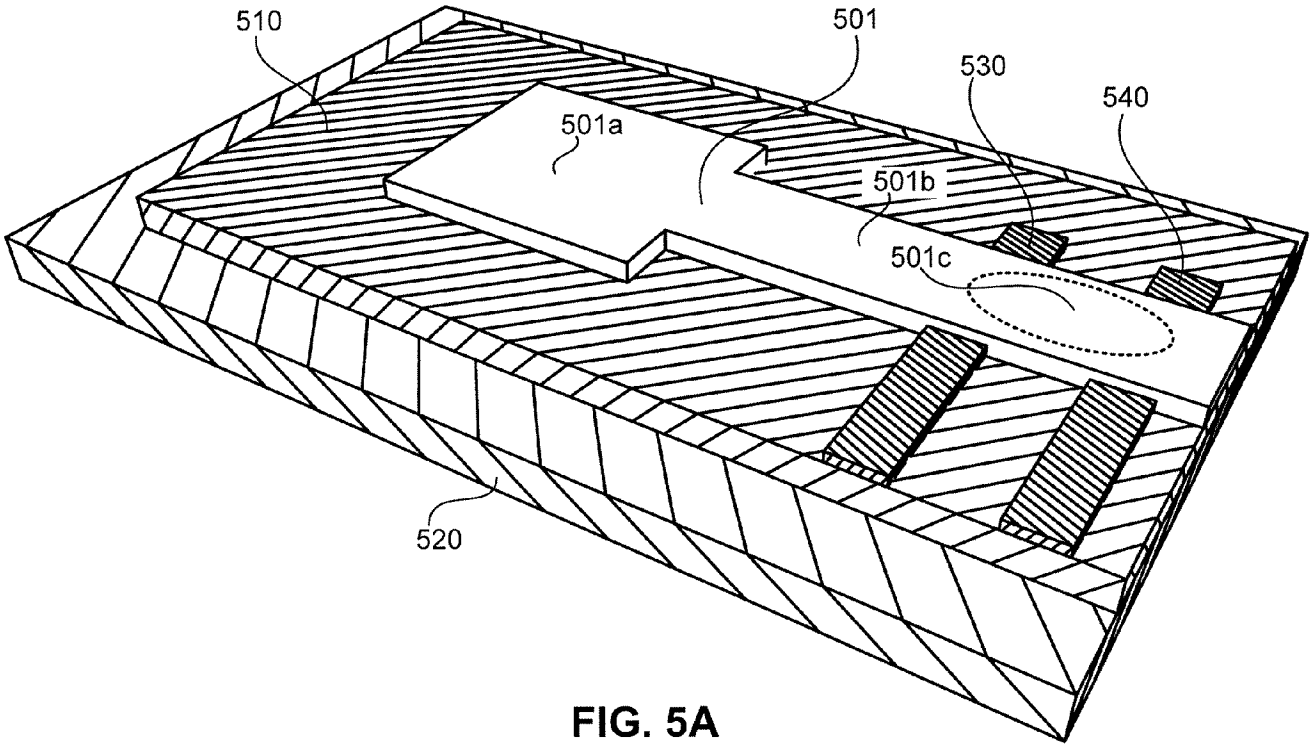
FIG. 5A is a perspective drawing illustrating a rectangular microstrip antenna element with an integrated two-terminal nanotube select device according to the methods of the present disclosure.

FIG. 5A illustrates a microstrip antenna which includes an integrated two terminal nanotube switch. U.S. patent application Ser. No. 11/280,786 to Bertin et al., incorporated herein by reference in its entirety, teaches a nonvolatile two terminal nanotube switch structure having (in at least one embodiment) a nanotube fabric article deposited over two electrically isolated electrode elements. As Bertin teaches, by placing different voltages across said electrode elements, the resistive state of the nanotube fabric article can be switched between a plurality of nonvolatile states. That is, in some embodiments the nanotube fabric article can be repeatedly switched between a relatively high resistive state (resulting in, essentially, an open circuit between the two electrode elements) and a relatively low resistive state (resulting in, essentially, a short circuit between the two electrode elements).

Referring now to FIG. 5A, a dielectric substrate layer 510 is deposited over ground plane layer 520. A first electrode element 530 and a second electrode element 540 are deposited over the dielectric substrate layer 510. Though not shown in FIG. 5A for the sake of clarity, the first and second electrode elements (530 and 540, respectively) are further electrically coupled to additional circuitry such that electrical stimulus can be applied as taught by Bertin in U.S. patent application Ser. No. 11/280,786. A shaped conductive nanotube fabric layer 501 (comprising a rectangular radiating structure 501*a* and a transmission line 501*b*) is further deposited over dielectric substrate layer 510 such that a portion of transmission line element 501*e* overlies the first and second electrode elements (530 and 540, respectively), thus forming an integrated two terminal nanotube switch (as taught by Bertin) wired in series with radiating structure 501*a*.

Figure 5B:
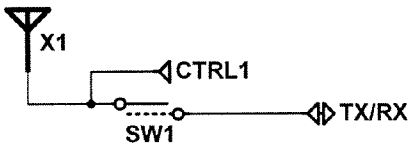
FIG. 5B is a schematic diagram illustrating the electrical circuit formed by the antenna structure depicted in FIG. 5A.

FIG. 5B is a schematic diagram illustrating the electrical circuit realized by the microstrip antenna structure depicted in FIG. 5A. Switch element SW1 corresponds to the two terminal nanotube switch formed by first electrode element 530, transmission line portion 501*c*, and second electrode element 540. Antenna element X1 corresponds to the microstrip antenna structure formed by radiating structure 501*a*, dielectric substrate layer 510, and ground plane layer 520. Node "CTRL1" corresponds to the first electrode element 530, and node "TX/RX" corresponds to second electrode element 540. It should be noted that node "TX/RX" includes both second electrode element 540 and the portion of shaped nanotube fabric layer 501 which extends beyond two terminal nanotube switch element SW1. That is, dependent on the needs of a specific application, additional circuitry used to drive or receive signals from radiating structure 501*a* can be electrically coupled through either second electrode element 540 or the portion of nanotube fabric layer 501 which extends beyond SW1.

Further, it should be noted that while the two terminal nanotube switch structure shown in FIG. 5A depicts a specific embodiment of the two terminal nanotube switch taught by Bertin in Ser. No. 11/280,786, the methods of the present disclosure are not limited in this regard. Indeed, based on the structure shown in FIG. 5A and the accompanying detailed description of said structure, it should be obvious to those skilled in the art that substantially all of the two terminal nanotube switch structures taught by Bertin could be integrated into the microstrip antenna structure of the present methods and systems.

The integrated two terminal nanotube switch (SW1 in FIG. 5B) provides an embedded selectability function within the microstrip antenna structure of the present disclosure. That is, the radiating structure (501*a* in FIG. 5A) can be electrically isolated from any transmitting or receiving circuitry electrically connected to node "TX/RX" without the need for additional complex circuitry which could impede the performance of the microstrip antenna structure. Further, as taught by Bertin in Ser. No. 11/280,786, this selectability function is non-volatile, allowing a complex antenna circuit (such as the microstrip antenna array depicted in FIGS. 6A and 6B and discussed in detail below) to be configured more easily and reliably.

Figure 6A:
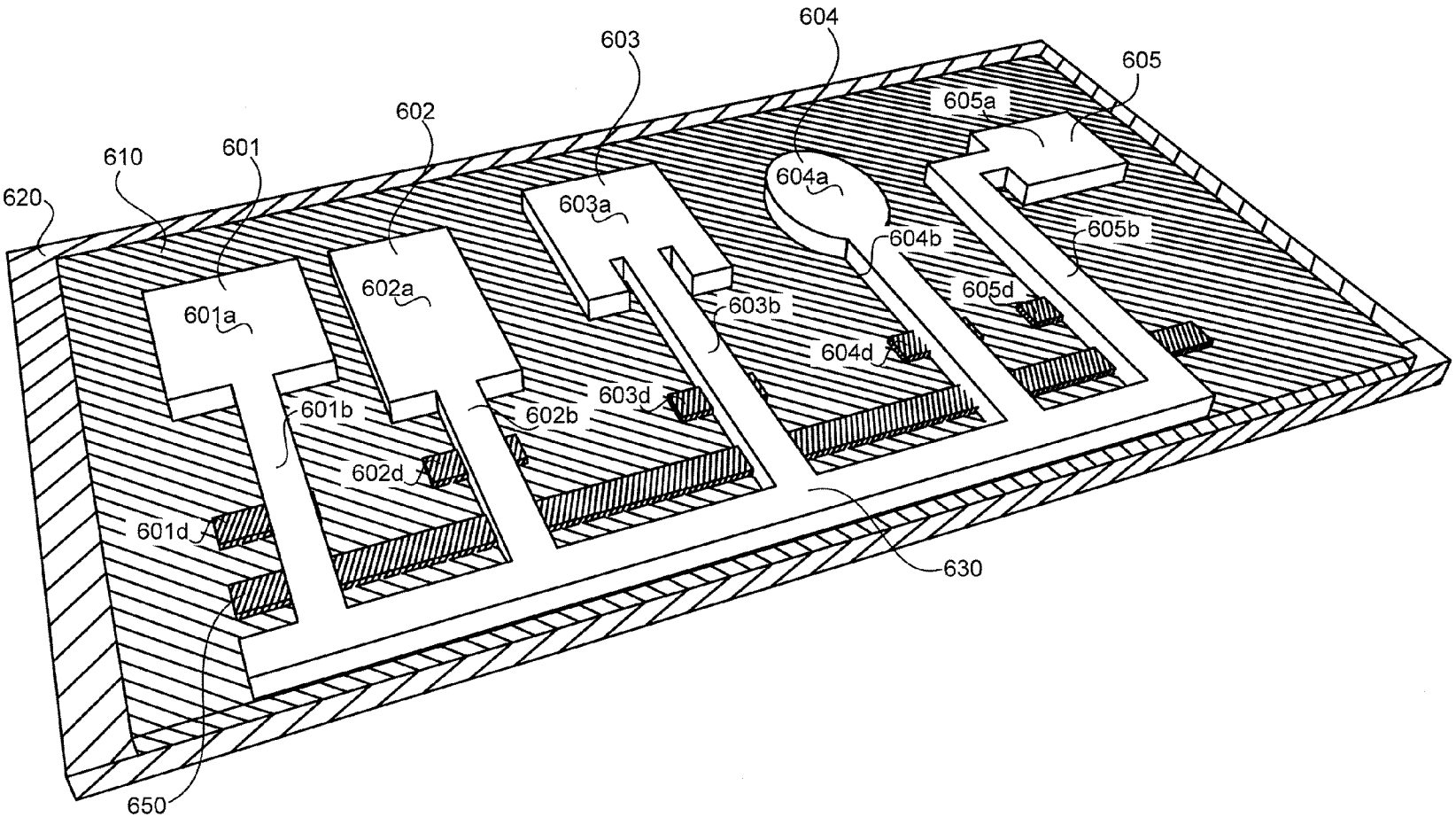
FIG. 6A is a perspective drawing illustrating a microstrip antenna array with integrated two-terminal nanotube select devices according to the methods of the present disclosure.

FIG. 6A depicts a microstrip antenna array structure according to the methods of the present disclosure including a plurality of individual microstrip antenna elements 601-605, wherein each of the microstrip antenna elements 601-605 includes an integrated two terminal nanotube switch element.

A dielectric substrate layer 610 is deposited over a ground plane layer 620. A plurality of send electrode elements 601*d*-605*d* and an elongated return electrode element 650 are further deposited over dielectric substrate layer 610. A continuous shaped nanotube fabric layer 630 is deposited over dielectric substrate layer 610 and is shaped to form a plurality of individual microstrip antenna elements 601-605, each of said individual microstrip antenna elements comprising a radiating structure (601*a*-605*a*, respectively) and a transmission line element (601*b*-605*b*, respectively). The continuous shaped nanotube fabric layer 630 is deposited such that a portion of the transmission line element (601*b*-605*b*) of each individual microstrip antenna element (601-605, respectively) is deposited over both a send electrode element (601*d*-605*d*, respectively) and the elongated return electrode element 650, forming a two terminal nanotube switch in series with each radiating structure (601*a*-605*a*).

Specifically, first individual microstrip antenna element 601 includes transmission line element 601*b* which overlies first send electrode element 601*d* and elongated return electrode element 650. Second individual microstrip antenna element 602 includes transmission line element 602*b* which overlies second send electrode element 602*d* and elongated return electrode element 650. Third individual microstrip antenna element 603 includes a transmission line element 603*b* which overlies third send electrode element 603*d* and elongated return electrode element 650. Fourth individual microstrip antenna element 604 includes a transmission line element 604*b* which overlies fourth send electrode element 604*d* and elongated return electrode element 650. And fifth individual microstrip antenna element 605 includes a transmission line element 605*b* which overlies fifth send electrode element 605*d* and elongated return electrode element 650.

The portion of continuous shaped nanotube layer 630 beyond elongated return electrode 650 and elongated return electrode 650 itself form a node which alternatively provides signals to (in a transmit operation) or is responsive to signals from (in a receive operation) the plurality of individual microstrip antenna elements 601-605.

Figure 6B:
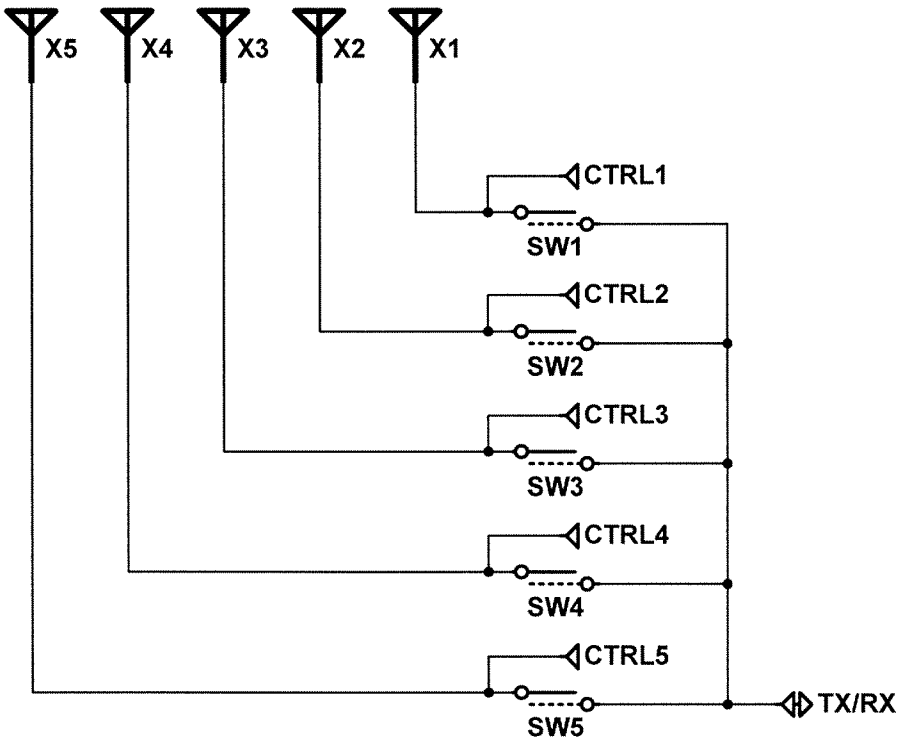
FIG. 6B is a schematic diagram illustrating the electrical circuit formed by the antenna structure depicted in FIG. 6A.

FIG. 6B is a schematic diagram illustrating the electrical circuit realized by the microstrip antenna array structure depicted in FIG. 6A. Switch elements SW1-SW5 correspond to the two terminal nanotube switch elements formed by the plurality of send electrode elements (601*d*-605*d*, respectively), transmission line elements (601*b*-605*b*, respectively), and the elongated return electrode element 650. Antenna elements X1-X5 correspond to the microstrip antenna structures formed by the plurality of radiating structures (601*a*-605*a*, respectively), dielectric substrate layer 610, and ground plane layer 620. Node "CTRL1" corresponds to the first send electrode element 601*d*, node "CTRL2" corresponds to the second send electrode element 602*d*, node "CTRL3" corresponds to the third send electrode element 603*d*, node "CTRL4" corresponds to the fourth send electrode element 604*d*, and node "CTRL5" corresponds to the fifth send electrode element 605*d*. Node "TX/RX" includes both elongated return electrode element 650 and the portion of shaped nanotube fabric layer 630 which extends beyond elongated return electrode element 650. As discussed in the description of the microstrip antenna array depicted in FIGS. 5A and 5B, additional circuitry (not shown in FIGS. 6A and 6B for the sake of clarity) used to provide electrical signals to or receive electrical signals from radiating structures 601*a*-605*a* can be electrically coupled through either elongated return electrode element 650 or the portion of nanotube fabric layer 630 which extends beyond elongated return electrode element 650 as best fits the needs of a specific application in which the array structure is employed.

It should be noted that while FIGS. 6A and 6B depict a single transmit/receive node ("TX/RX" in FIG. 6B) which alternatively provides signals to (in a transmit operation) or is responsive to signals from (in a receive operation) the plurality of the individual microstrip antenna elements 601-605, the methods of the present disclosure are not limited in this regard. Indeed, it should be obvious to those skilled in the art that elongated return electrode element 650 could be replaced with a plurality of electrically independent return electrode elements and that continuous shaped nanotube fabric layer 630 could be instead deposited, etched, or otherwise formed in such a way as to provide a plurality of physically independent microstrip antenna elements which are electrically isolated from each other.

A distinct advantage to using a shaped nanotube fabric layer to form the radiating structure of a microstrip antenna is the ease to which such a layer can be conformed to an underlying structure. U.S. Pat. No. 6,924,538 to Jaiprakash et al., incorporated herein by reference, teaches the formation of a nanotube fabric layer (comprised of carbon nanotubes in some embodiments) which substantially conforms to an underlying substrate (including, but not limited to, substrates comprising vertical surfaces). Jaiprakash teaches a plurality of application techniques for forming such a conformal nanotube fabric layer such as, but not limited to, chemical vapor deposition, spin coating suspensions of nanotubes, spray coating of aerosolized nanotube suspensions, and dip coating from a solution of suspended nanotubes. The ability to form nanotube fabric layers which so readily conform to an application surface allows for the creation of vertically and horizontally polarized antennas, as shown in FIG. 8 and discussed in detail below.

FIGS. 7A-7C are micrograph images depicting a nanotube fabric layer 701 deposited over a non-planer substrate layer 710 at increasing magnifications (as indicated by the legend in each figure) and illustrate how such a fabric layer looks when formed and made to conform over vertical and horizontal surfaces. Looking to FIG. 7B, step structure 710*a* is etched $SiO_2$ and is several hundred nanometers high. Looking specifically to FIG. 7C, it can be seen that the deposited nanotube fabric layer 701 has conformed to the underlying surface, resulting in both horizontal 701*a* and vertical 701*b* surfaces within the nanotube fabric layer 701 itself. It should be noted that the horizontal 701*a* and vertical 701*b* surfaces of nanotube fabric layer 701 have a substantially uniform thickness.

Figure 8:
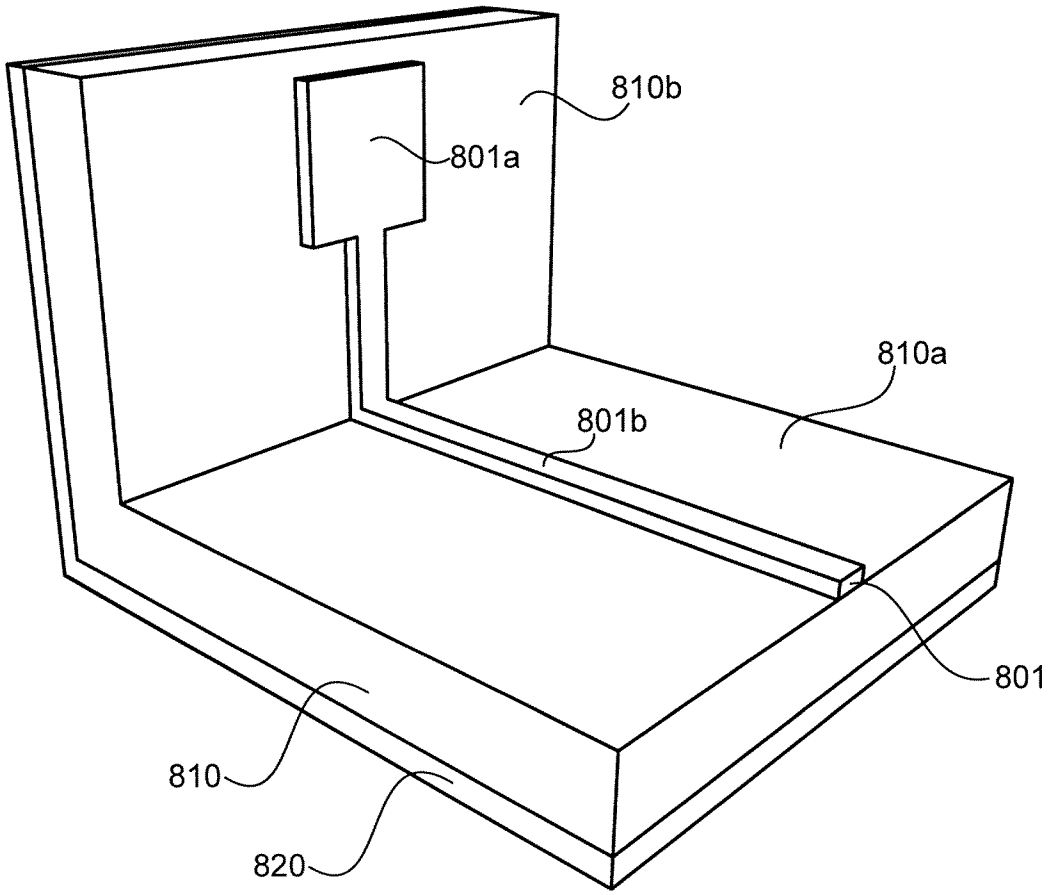
FIG. 8 is a perspective drawing illustrating a vertically disposed rectangular microstrip antenna element according to the methods of the present disclosure.

To this end, FIG. 8 depicts a microstrip antenna element which has been fabricated to conform to a vertical surface. A dielectric substrate layer 810 is formed over a conductive structure 820 such that said dielectric substrate layer 810 comprises both a horizontal surface 810*a* and a vertical surface 810*b*. A shaped nanotube fabric layer 801 (comprising rectangular radiating structure 801*a* and transmission line element 801*b*) is deposited over dielectric substrate layer 810, conforming to the underlying dielectric substrate layer 810 such that radiating structure 801*a* is formed over the vertical surface 810*b* of dielectric substrate layer 810. In this way, the three dimensional orientation of—and, by extension the directivity of—a microstrip antenna element can be controlled during the fabrication process.

Figure 9:
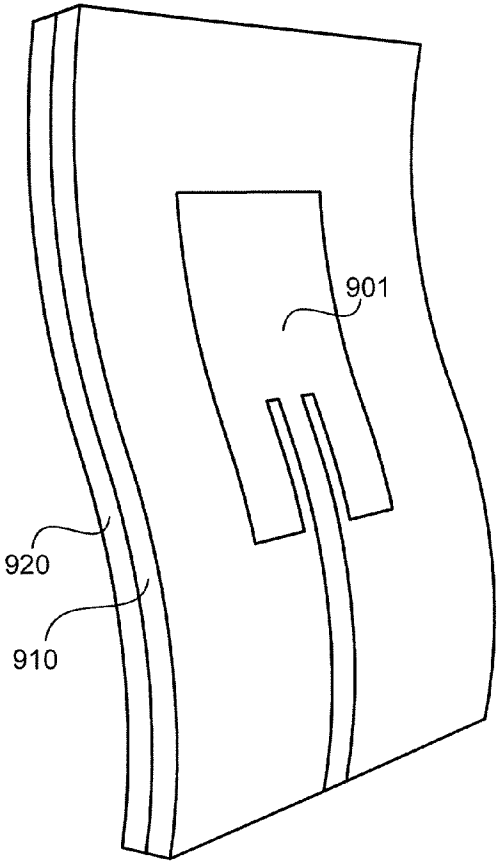
FIG. 9 is a perspective drawing illustrating a flexible microstrip antenna element according to the methods of the present disclosure.

FIG. 9 illustrates a flexible microstrip antenna element. A continuous nanotube fabric layer 901 can be deposited (via a spray coating process, for example) on a wide variety of substrates such as plastics and other flexible membranes and non-standard substrates such as walls. This nanotube fabric layer 901 can then be patterned into a required geometry to foam a radiating structure and transmission line. In this way, nanotube based microstrip antenna elements can be realized on a roll-to-roll process for flexible electronics and readily integrated within wireless communication architectures, for example, by using standard complementary metal-oxide-semiconductor (CMOS) integration techniques. Techniques and descriptions of the patterning of nanotube fabrics are more fully described in the incorporated references.

U.S. Pat. No. 8,574,673 incorporated herein by reference in its entirety, teaches a plurality of methods of forming shaped anisotropic nanotube fabric layers. In some embodiments, these anisotropic nanotube fabric layers have a relatively high transparency to radiation, including radiation in both the optical and x-ray spectrums, while retaining a relatively low sheet resistance. Further, some embodiments teach methods of forming nanotube fabric layers and films in predetermined geometries. Such methods include, but are not limited to, flow induced alignment of nanotube elements as they are projected onto a substrate, the use of nematic nanotube application solutions, and the use of nanotube adhesion promoter materials.

Figure 10:
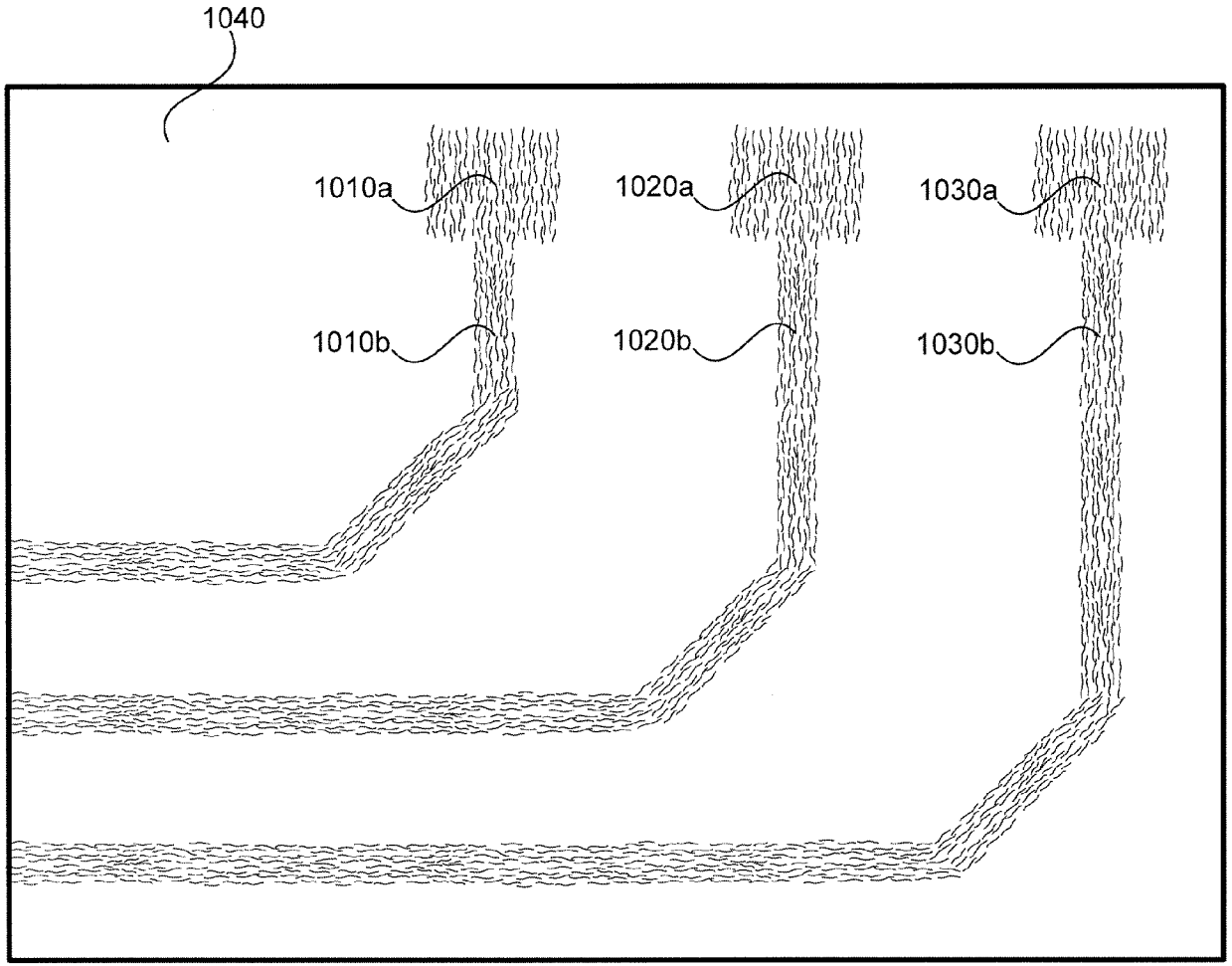
FIG. 10 is a perspective drawing illustrating an anisotropic nanotube fabric layer shaped to form an array of three radiating structures, according to the methods of the present disclosure.

FIG. 10 illustrates an anisotropic nanotube fabric layer shaped to form an array of three radiating structures (1010*a*, 1020*a*, and 1030*a*) and three transmission line elements (1010*b*, 1020*b*, and 1030*b*) over a substrate layer 1040. As the shaped nanotube fabric layer shown in FIG. 10 is substantially anisotropic, it remains highly conductive even when formed into a single monolayer of non-overlapping nanotube elements. In this way, such anisotropic nanotube fabric layers can remain highly transparent while still providing a material layer of sufficient conductivity as to provide radiating structures for microstrip antenna elements.

Figure 11:
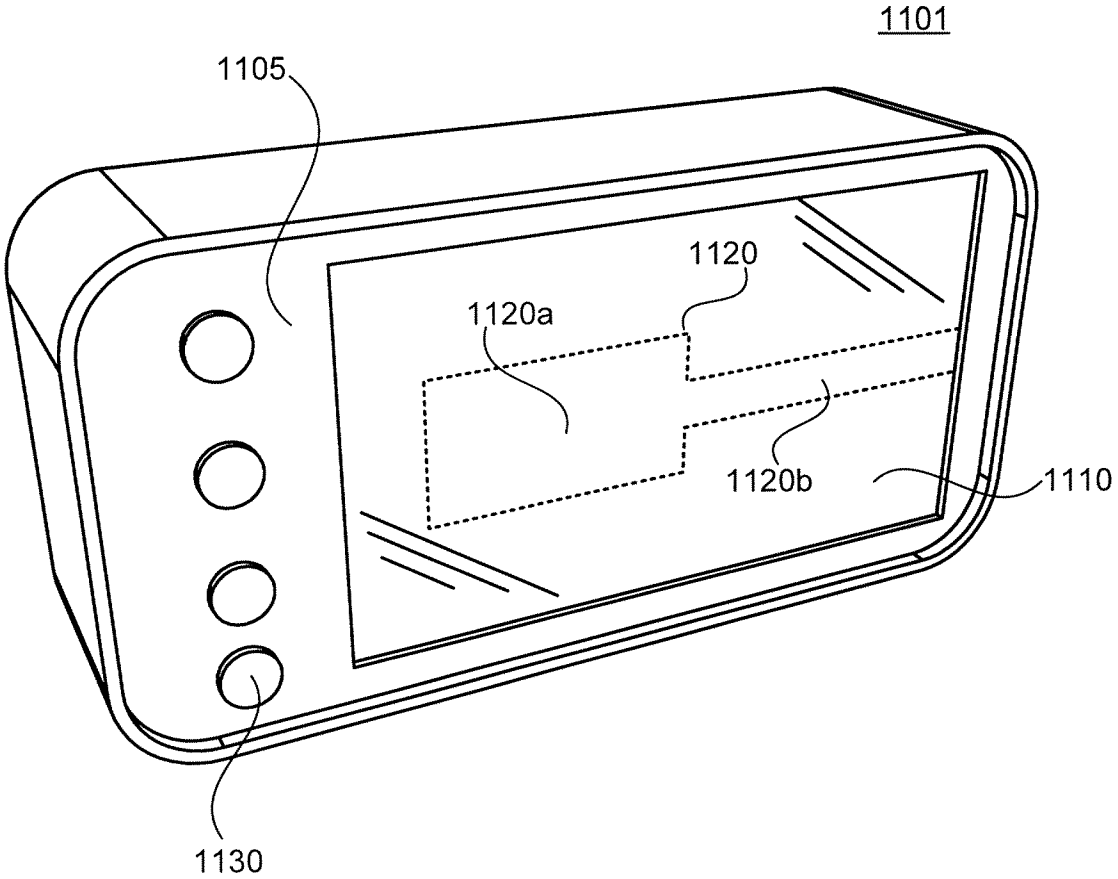
FIG. 11 is a perspective drawing illustrating an electronic device comprising a transparent microstrip antenna element within its display screen, according to the methods of the present disclosure.

To this end, FIG. 11 illustrates a portable electronic device 1101 which includes a front panel interface 1105, said front panel interface comprising a plurality of input buttons 1130 and a display screen 1110. A substantially transparent nanotube fabric layer 1120 (shaped to form a radiating structure 1120*a* and a transmission line element 1120*b*) is deposited over display screen 1110, forming—along with a ground plane layer situated behind display screen 1110 (not shown in FIG. 11)—a microstrip antenna element as described in the present disclosure. In this way a microstrip antenna element can be integrated into such a portable electronic device 1101 without impeding an operator's ability to view images or information presented on display screen 1110.

Although the present invention has been described in relation to particular embodiments thereof, many other variations and modifications and other uses will become apparent to those skilled in the art. It is preferred, therefore, that the present invention, as recited in the following claims, not be limited by the specific disclosure herein.

What is claimed is:

1. An antenna element comprising:

a ground plane layer;

a dielectric substrate layer deposited over said ground plane layer;

at least two electrode elements deposited over said dielectric substrate layer;

a patterned non-woven nanotube fabric layer deposited over said dielectric substrate layer, said patterned non-woven nanotube fabric layer comprising a shaped radiating structure and a transmission line element; and wherein said transmission line element overlies two electrode elements to form a two-terminal nanotube switch, said two-terminal nanotube switch comprising a nanotube fabric element that is adjustable among at least two non-volatile resistive states responsive to an electrical stimulus applied to said two electrode elements;

wherein said two-terminal nanotube switch comprises an integrated switching element that provides an embedded selectability function to said antenna element;

wherein said integrated switching element, said transmission line element, and said radiating structure are formed within a single contiguous material layer.

2. The antenna element of claim 1 wherein said patterned non-woven nanotube fabric layer is comprised of carbon nanotubes.

3. The antenna element of claim 1 wherein at least one of said ground plane layer, said dielectric substrate layer, and said patterned non-woven nanotube fabric layer is substantially flexible.

4. The antenna element of claim 1 wherein at least one of said ground plane layer, said dielectric substrate layer, and said patterned non-woven nanotube fabric layer is substantially transparent.

5. The antenna element of claim 1 wherein at least one of said ground plane layer, said dielectric substrate layer, and said patterned non-woven nanotube fabric layer is substantially non-planer.

6. The antenna element of claim 1 wherein said shaped radiating structure is vertically oriented.

7. The antenna element of claim 1 wherein said two-terminal nanotube switch is used to couple and decouple said radiating structure from at least a portion of said transmission line element.

8. An antenna array comprising:

a ground plane layer;

a dielectric substrate layer deposited over said ground plane layer;

at least two electrode elements deposited over said dielectric substrate layer;

a patterned non-woven nanotube fabric layer deposited over said dielectric substrate layer, said patterned non-woven nanotube fabric layer comprising a plurality of shaped radiating structures and a plurality of transmission line elements; and wherein at least one of said plurality of transmission line elements overlies at least two electrode elements to form at least one two-terminal nanotube switch, said at least one nanotube select device comprising a nanotube fabric element that is adjustable among at least two non-volatile resistive states responsive to an electrical stimulus applied to said at least two electrode elements;

wherein said at least one two-terminal nanotube switch comprises an integrated switching element that provides an embedded selectability function to said antenna element; and wherein said integrated switching element, said plurality of transmission line elements, and said plurality of shaped radiating structure are formed within a single contiguous material layer.

9. The antenna array of claim 8 wherein said patterned non-woven nanotube fabric layer is comprised of carbon nanotubes.

10. The antenna array of claim 8 wherein at least one of said ground plane layer, said dielectric substrate layer, and said patterned non-woven nanotube fabric layer is substantially flexible.

11. The antenna array of claim 8 wherein at least one of said ground plane layer, said dielectric substrate layer, and said patterned non-woven nanotube fabric layer is substantially transparent.

12. The antenna array of claim 8 wherein at least one of said ground plane layer, said dielectric substrate layer, and said patterned non-woven nanotube fabric layer is substantially non-planer.

13. The antenna array of claim 8 wherein at least two of said plurality of transmission line elements are electrically coupled.

14. The antenna array of claim 8 wherein said plurality of shaped radiating structures are all substantially the same shape.

15. The antenna array of claim 8 wherein at least two of said plurality of shaped radiating structures are different shapes.

16. The antenna array of claim 8 wherein at least one of said plurality of shaped radiating structures is vertically oriented.

17. The antenna array of claim 8 wherein said at least one two-terminal nanotube switch is used to couple and decouple at least one of said plurality of radiating structures from at least a portion of at least one of said plurality of transmission line elements.

* * * * *